US006170933B1

(12) United States Patent
Nitta et al.

(10) Patent No.: US 6,170,933 B1
(45) Date of Patent: Jan. 9, 2001

(54) PRINTER CONTROL APPARATUS

(75) Inventors: Noboru Nitta, Shizuoka-ken; Jun Takamura, Mishima; Shunichi Ono, Shizuoka-ken, all of (JP)

(73) Assignee: Toshiba Tec Kabushiki Kaisha, Tokyo (JP)

( * ) Notice: Under 35 U.S.C. 154(b), the term of this patent shall be extended for 0 days.

(21) Appl. No.: 09/383,568

(22) Filed: Aug. 25, 1999

(30) Foreign Application Priority Data

Aug. 28, 1998 (JP) ..... 10-243670
Aug. 11, 1999 (JP) ..... 11-227616

(51) Int. Cl.[7] ..... B41J 2/155; B41J 2/05
(52) U.S. Cl. ..... 347/42; 347/57
(58) Field of Search ..... 347/42, 14, 10, 347/11, 57

(56) References Cited

FOREIGN PATENT DOCUMENTS 5-305747 11/1993 (JP) .
6-055795 3/1994 (JP) .
7-266580 10/1995 (JP) .
8-156328 6/1996 (JP) .

*Primary Examiner*—Thinh Nguyen
(74) *Attorney, Agent, or Firm*—Frishauf, Holtz, Goodman, Langer & Chick, P.C.

(57) ABSTRACT

A printer control apparatus includes a rotary encoder for detecting the rotational position of a rotary drum around which printing paper is wound and outputting a timing pulse, a reference point pulse creating circuit for outputting a reference point pulse based on the timing pulse, an up-counter for measuring the passage time of the reference point interval based on the reference point pulse, a plurality of comparators for generating a train of print timing pulses in a time interval corresponding to and shorter than the passage time of the reference point interval measured, a multiplier circuit having a different up-counter for determining the total required time of the train of print timing pulses, a print timing correction circuit for correcting the print timing pulse train based on the driving frequency of the ink-jet print head, and a head drive circuit for driving the head according to the print timing pulse train from the correction circuit.

14 Claims, 30 Drawing Sheets

T2=933(93.3 μs/10.7KHz)
T1=833(83.3 μs/12.0KHz)
T0=733(73.3 μs/13.6KHz)

| ADDRESS C | ADDRESS F | DATA Tn | MEMO |
|---|---|---|---|
| 13 | 5 | T2 | 6T2 5598 |
| | 4 | T2 | |
| | 3 | T2 | |
| | 2 | T2 | |
| | 1 | T2 | |
| | 0 | T2 | |
| 12 | 5 | T2 | T1+5T2 5498 |
| | 4 | T2 | |
| | 3 | T1 | |
| | 2 | T2 | |
| | 1 | T2 | |
| | 0 | T2 | |
| 11 | 5 | T2 | 2T1+4T2 5398 |
| | 4 | T1 | |
| | 3 | T2 | |
| | 2 | T2 | |
| | 1 | T1 | |
| | 0 | T2 | |
| 10 | ≈ | | 3T1+3T2 5298 |
| 9 | | | 4T1+2T2 5198 |
| 8 | 5 | T1 | 5T1+T2 5098 |
| | 4 | T1 | |
| | 3 | T2 | |
| | 2 | T1 | |
| | 1 | T1 | |
| | 0 | T1 | |
| 7 | 5 | T1 | 6T1 4998 |
| | 4 | T1 | |
| | 3 | T1 | |
| | 2 | T1 | |
| | 1 | T1 | |
| | 0 | T1 | |
| 6 | 5 | T1 | T0+5T1 4898 |
| | 4 | T1 | |
| | 3 | T1 | |
| | 2 | T0 | |
| | 1 | T1 | |
| | 0 | T1 | |
| 5 | ≈ | | 2T0+4T1 4798 |
| 4 | | | 3T0+3T1 4698 |
| 3 | 5 | T0 | 4T0+2T1 4598 |
| | 4 | T1 | |
| | 3 | T0 | |
| | 2 | T0 | |
| | 1 | T1 | |
| | 0 | T0 | |
| 2 | 5 | T0 | 5T0+T1 4498 |
| | 4 | T0 | |
| | 3 | T1 | |
| | 2 | T0 | |
| | 1 | T0 | |
| | 0 | T0 | |
| 1 | 5 | T0 | 6T0 4398 |
| | 4 | T0 | |
| | 3 | T0 | |
| | 2 | T0 | |
| | 1 | T0 | |
| | 0 | T0 | |
| 0 | 0~5 | 0 | |

FIG. 19

| | DATA | | | MEMO |
|---|---|---|---|---|
| ADDRESS | wtime | wstart | cwf | |
| 15 | 255 | 0 | 0 | |
| 14 | 255 | 0 | 0 | AFTER DRIVING FOR ONE DOT |
| 13 | 30 | 1 | 1 | |
| 12 | 70 | 1 | 0 | |
| 11 | 30 | 1 | 1 | |
| 10 | 70 | 1 | 0 | |
| 9 | 30 | 1 | 1 | |
| 8 | 70 | 1 | 0 | |
| 7 | 30 | 1 | 1 | |
| 6 | 70 | 1 | 0 | |
| 5 | 30 | 1 | 1 | |
| 4 | 70 | 1 | 0 | |
| 3 | 30 | 1 | 1 | |
| 2 | 70 | 1 | 0 | |
| 1 | 30 | 1 | 1 | AFTER INPUT OF PRINT TIMING PULSE |
| 0 | 255 | 0 | 0 | AFTER SYSTEM RESET |

PRINTER CONTROL APPARATUS

BACKGROUND OF THE INVENTION

This invention relates to a printer control apparatus for controlling an ink-jet printer, for example.

A general ink-jet printer performs printing with a print head which is relatively moved with respect to printing paper. Jpn. Pat. Appln. KOKAI Publication No. 7-266580 discloses an ink-jet printer which performs printing by use of an ink-jet print head 2 disposed to face printing paper wound around a rotary drum 1 as shown in FIG. 34. The rotary drum 1 is rotated by a motor 3 and rotation of the rotary drum 1 is detected by an encoder 4. A motor 5 rotates a rotating shaft 6 disposed in parallel to the rotary drum 1 so as to move a fixed table 7 having the print head 2 mounted thereon in parallel to the rotary drum 1. Specifically, if the rotary drum 1 is rotated by the motor 3, the encoder 4 detects the rotation of the drum 1 to output a signal at each preset pitch and a CPU 8 receives the signal to drive a driver 9 which in turn drives the print head 2 in synchronism with the signal. Further, the CPU 8 drives the motor 5 in synchronism with the rotation of the rotary drum 1 to move the print head 2 by a preset amount. Thus, printing is done on printing paper wound around the rotary drum 1.

Further, in Jpn. Pat. Appln. KOKAI Publication No. 8-156328, as shown in FIG. 35, a print head 13 mounted on a carrier 12 is disposed to face a platen 11 and the carrier 12 is fixed on a carrier belt 16 which is stretched between the rotating shaft of a carrier motor 14 disposed on one side in the main scanning direction and the encoder shaft of a slit disk 15 of a 2-phase encoder disposed on the other side. The carrier belt 16 is driven by rotation of the carrier motor 14 to control and move the carrier 12 along a shaft 17 in the main scanning direction. The slit disk 15 is rotated by driving the carrier belt 16 and passage of each slit of the slit disk 15 is detected by an encoder sensor 18, and phase "A " and phase "B" outputs are generated as shown in FIG. 36.

The relative movement between the print head and the recording medium is generally attained at a constant speed by use of the motor, and during the relative movement, dots are printed on the recording medium at regular intervals by driving the print head in a preset cycle. The dot pitch is expressed by the unit of dpi (dot/inch) and is generally set to approx. 300 dpi to 1200 dpi.

The printing precision is primarily reduced by a degradation in the constant velocity of the relative movement. Therefore, the encoder is provided to detect the position of the drum which is required for a rotation and movement control. For example, in the case of FIG. 34, rotation of the rotary drum 1 is detected by the encoder 4 and the CPU 8 feedback-controls the speed of the motor 3 to make the time interval corresponding to the detected value constant.

However, in the above method, there is a limitation in the printing precision. One of the reasons is that delay time occurs in the feedback control without fail and it takes a long time until the variation is suppressed. Another reason is that the gain of the feedback loop cannot be made excessively large because of the delay time.

In the case of FIG. 35, the movement of the carrier 12 is detected when the encoder sensor 18 detects passage of each slit of the slit disk 15 rotated by driving the carrier belt 16 and a print timing pulse for starting the driving of the print head 13 is created according to the result of detection. The print head 13 can be driven to follow the movement of the carrier 12 by driving the print head 13 at the timing of the print timing pulse.

Further, in Jpn. Pat. Appln. KOKAI Publication No. 8-156328, an attempt is made to enhance the printing resolution. That is, as shown in FIG. 37, an up-counter 19 and down-counter 20 are provided, a Load 1 signal is derived from the phase "A" output ((a) in FIG. 38) from the encoder sensor 18 as shown in (c) of FIG. 38 and the Load 1 signal is input to the Load terminal of the up-counter 19. The up-counter 19 counts the pulse interval of the Load 1 signal by use of a clock CLK and the down-counter 20 is loaded with a value which is half the maximum count of the up-counter 19 by a Load 2 signal shown in (e) of FIG. 38 and counts the same. Therefore, a timing pulse is output from the down-counter 20 at a timing which is half the period of the Load 1 signal. The timing signal and a signal obtained by inverting the Load 1 signal by an inverter 21 are input to an OR gate 22 so as to output a print timing signal as shown in (d) of FIG. 38 with the resolution which is twice the resolution of the encoder.

Thus, the ink-jet printer disclosed in Jpn. Pat. Appln. KOKAI Publication No. 8-156328 has an advantage that it can cope with the high resolution.

However, the ink-jet printer disclosed in Jpn. Pat. Appln. KOKAI Publication No. 8-156328 is effective in a case where the Load 1 signal, that is, a reference point pulse is halved to create a print timing signal and the number of divisions is small, but a problem occurs when the number of divisions is increased to further enhance the resolution.

For example, assume a case wherein an interval of reference point pulses is divided into six portions. As shown in FIG. 39, when the reference point pulses are changed to have intervals a1, a2, a3, a4, a5, the print timing pulses are obtained as a combination of pulses of a period which is ⅙ of each of a1 to a5 and the original reference point pulses so that a difference between the intervals of the reference point pulses will be concentrated on the last one of the six-divided periods. That is, when the print timing pulses are created based on the interval a1 of the reference point pulses, the interval a1 is divided into six portions, but since the period used when printing is actually done is the interval a2 which appears one period after the interval a1, the first to fifth print timing pulses are created based on the contents of the divisions, but the sixth print timing pulse is created based on the reference point pulse and the last pulse interval of the print timing pulses becomes shorter if the interval a2 is shorter than the interval a1. If the time width of the pulse interval becomes shorter than the response time of the print head, there occurs a problem that printing will not be done.

Therefore, as shown in FIG. 40, if the next reference point pulse is not used to create the sixth print timing pulse and this print timing pulse is created at a timing obtained by dividing the interval a1 into six portions, the first interval of the print timing pulses of the next period becomes shorter, thereby causing the same problem.

Thus, in the prior art, in a case where the print control is effected by detecting the relative position between the print head and the recording medium by use of the encoder, there occurs a problem that printing cannot be done if the number of divisions of the reference point pulse interval is increased to enhance the printing precision.

BRIEF SUMMARY OF THE INVENTION

A first object of this invention is to provide a printer control apparatus capable of enhancing the printing precision and attaining stable printing.

A second object of this invention is to provide a printer control apparatus capable of making correction by taking the response performance of a print head into consideration, enhancing the printing quality and attaining high-speed printing.

The first object of this invention can be attained by a printer control apparatus for a printer which performs printing on a recording medium relatively moved with respect to a print head, comprising position detecting means for detecting the relative movement between the print head and the recording medium at each equal positional interval; time measuring means for measuring passage time of the positional interval detected by the position detecting means; print timing pulse train generating means for generating a train of print timing pulses with a time interval corresponding to and shorter than the passage time of the positional interval measured by the time measuring means; head driving means triggered by the print timing pulses from the print timing pulse train generating means, for driving the print head; and print-required time determining means for determining total required time for generation of the train of print timing pulses from the print timing pulse train generating means according to the passage time of the positional interval measured by the time measuring means; wherein the print timing pulse train generating means is arranged such that generation of a next train of print timing pulses starts when the total required time determined by the print-required time determining means has elapsed after generation of the print timing pulse train.

The second object of this invention can be attained by a printer control apparatus for a printer which performs printing on a recording medium relatively moved with respect to a print head, comprising reference point pulse generating means for generating a reference point pulse each time it is measured or predicted that the relative position between the print head and the recording medium has reached a position of a predetermined equal positional interval; pulse correcting means for correcting pulse generation time of the reference point pulse from the reference point pulse generating means according to a predetermined constraint condition to output print timing pulses; and head driving means triggered by the print timing pulses from the pulse correcting means, for driving the print head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 19 is a diagram showing one example of a table provided in the print timing pulse generating circuit shown in FIG. 10;

DETAILED DESCRIPTION OF THE INVENTION

There will now be described a printer control apparatus according to a first embodiment of this invention with reference to the accompanying drawings.

Figure 1:
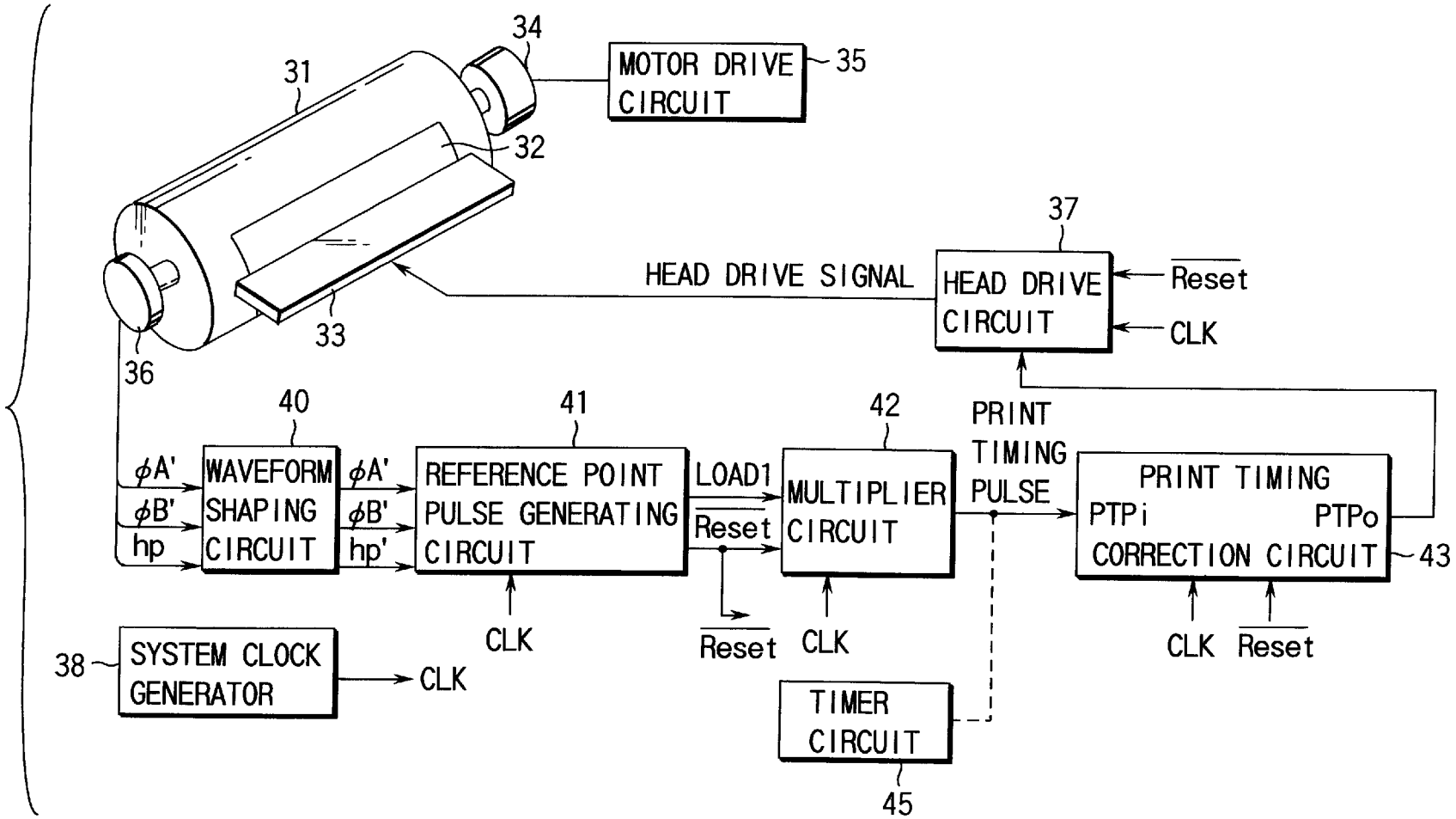
FIG. 1 is a block diagram of a printer control apparatus according to a first embodiment of this invention.

FIG. 1 shows the whole construction of a printer control apparatus. The printer control apparatus is applied to an ink-jet printer including a rotary drum 31 rotated along with printing paper 32 used as a recording medium wound on the surface thereof and a line-type ink-jet print head 33 disposed to face the rotary drum 31 and extending in a direction parallel to the axis thereof. The printer control apparatus includes a motor 34 for rotating the rotary drum 31, a motor drive circuit 35 for driving the motor 34, a rotary encoder 36 serving as position detecting means for detecting the relative position between the ink-jet print head 33 and the printing paper 32 at each equal positional interval, and a head drive circuit 37 used as head driving means for driving the ink-jet print head 33.

For example, the ink-jet print head 33 is a line head having 2400 ink-jet nozzles which are arranged at an interval of 300 dpi, that is, 2400 dots in the main scanning direction and have a span corresponding to paper width. For example, the rotary drum 31 is rotated at 200 rpm by the motor 34 and printing for one sheet of printing paper is completed by one rotation of the rotary drum 31, that is, by 0.3 sec. The rotary encoder 36 has a resolution of 600 slits/rotation. The circumferential length of the rotary drum 31 is 12 inches and printing is done with 300 dpi in the rotating direction of the drum, that is, in the sub-scanning direction. Therefore, as the print timing pulses of one rotation of the rotary drum, 300 dpi×12 inches=3600 pulses are required. The value corresponds to six times the number 600 of slits of the rotary encoder 36. Therefore, in this example, printing is done by use of print timing pulses obtained by multiplying a signal obtained by detecting each slit of the rotary encoder 36 by six.

A system clock generator 38 is used to generate a system clock CLK of 10 MHz. The motor 34 is controlled to be rotated at substantially a constant speed by the motor drive circuit 35. A variation in the rotation speed of the rotary drum 31 is suppressed to within +13% and −11% with respect to 200 rpm. This corresponds to the rotation speed of 178 rpm to 227 rpm. Further, this corresponds to 559.8 $\mu$s to 439.8 $\mu$s in terms of the passage time between the slits.

A home position detecting signal hp and 2-phase timing pulses $\phi$A, $\phi$B are output from the rotary encoder 36. The home position detecting signal hp and timing pulses $\phi$A, $\phi$B output from the rotary encoder 36 are binary-coded after the noises thereof are eliminated by a waveform shaping circuit 40. The thus binary-coded home position detecting signal hp, and timing pulses $\phi$A', $\phi$B' are input to a reference point pulse generating circuit 41. The home position detecting signal hp is output at one specified portion on the rotary drum 31, and therefore, the print starting point can be determined by detecting the timing of the home position detecting signal hp and then counting the encoder pulse.

Figure 2:
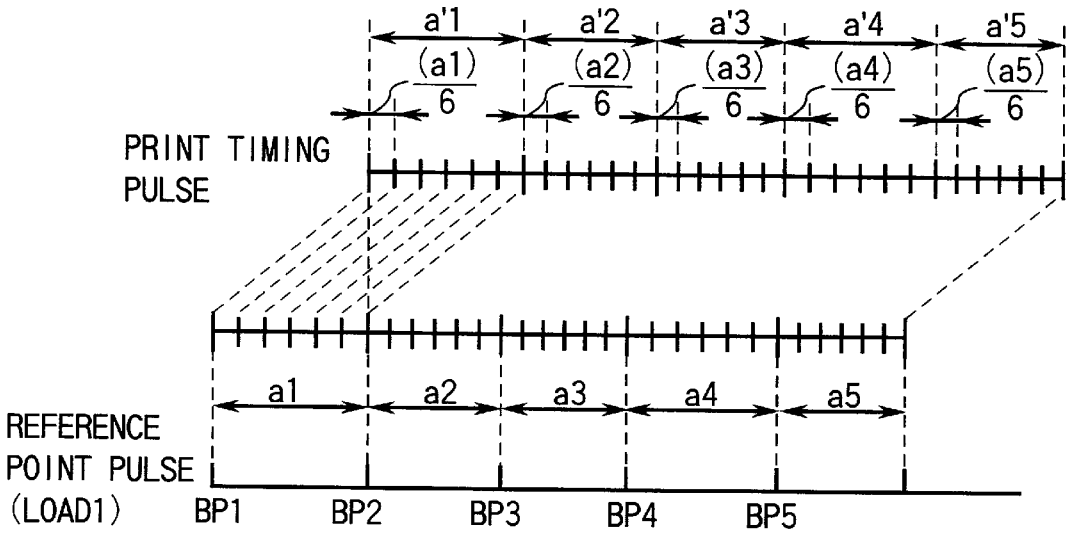
FIG. 2 is a timing waveform diagram for illustrating the function of a multiplier circuit shown in FIG. 1.

The reference point pulse generating circuit 41 outputs a reference point pulse LOAD1 in synchronism with the rise of the timing pulse $\phi$A', supplies the same to a multiplier circuit 42 and raises a signal /Reset at the print starting point in the rotating direction of the rotary drum 31. As shown in FIG. 2, the multiplier circuit 42 divides the reference point pulse LOAD1 by 6 to create print timing pulses and supplies the same to a print timing correction circuit 43. The print timing correction circuit 43 corrects each print timing pulse and then supplies the corrected print timing pulse to the head drive circuit 37.

The multiplier circuit 42 creates print timing pulses by dividing each interval between the reference point pulses BP1, BP2, BP3, BP4, BP5, . . . by 6 and the timing is started at the reference point pulse BP2. Values a1', a2', a3', a4', a5', . . . each of which is derived by adding intervals between the thus created print timing pulses for every six pulses coincide with intervals a1, a2, a3, a4, a5, . . . between the pulses starting from the reference point pulse BP1 which occurs one cycle before the reference point pulse BP2.

The multiplier circuit 42 creates print timing pulses by dividing the reference point pulse LOAD1 by 6, but in this example, in order to clarify the explanation, the construction thereof is explained in a case wherein the reference point pulse LOAD1 is divided by 4 to create print timing pulses.

Figure 3:
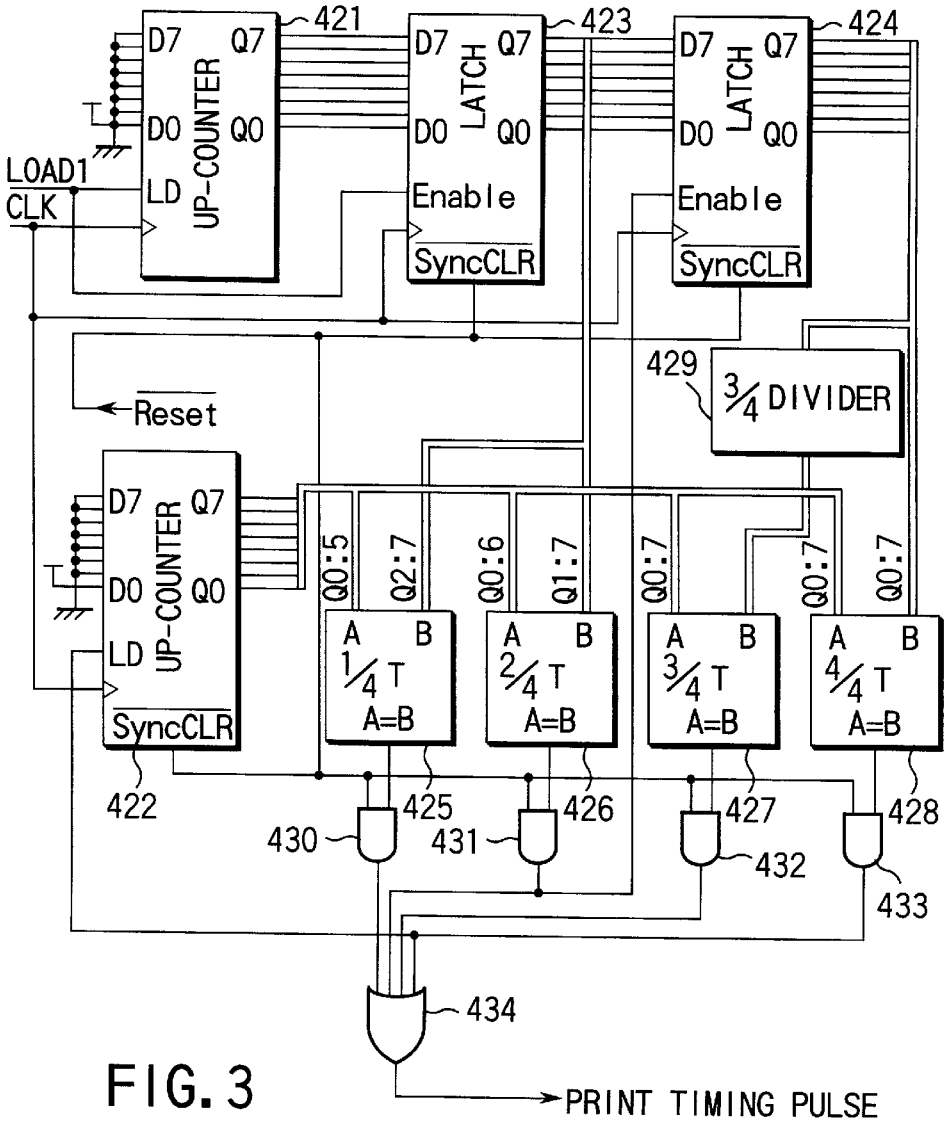
FIG. 3 is a block diagram showing the construction of the multiplier circuit shown in FIG. 1 in a case where the reference point pulse interval is divided into four portions to create print timing pulses.

As shown in FIG. 3, the multiplier circuit includes two up-counters 421, 422, two latch circuits 423, 424, four comparators 425, 426, 427, 428, a single ¾-divider 429, four 2-input AND gates 430, 431, 432, 433, and 4-input OR gate 434. The reference point pulse LOAD1 is supplied to the load terminal LD of the up-counter 421 and the enable terminal Enable of the latch circuit 423.

The system clock CLK from the system clock generator 38 is supplied to the up-counters 421, 422 and latch circuits 423, 424. Further, the signal /Reset which rises at the print starting time is supplied to the up-counter 422, latch circuits 423, 424 and AND gates 430 to 433.

Figure 4:
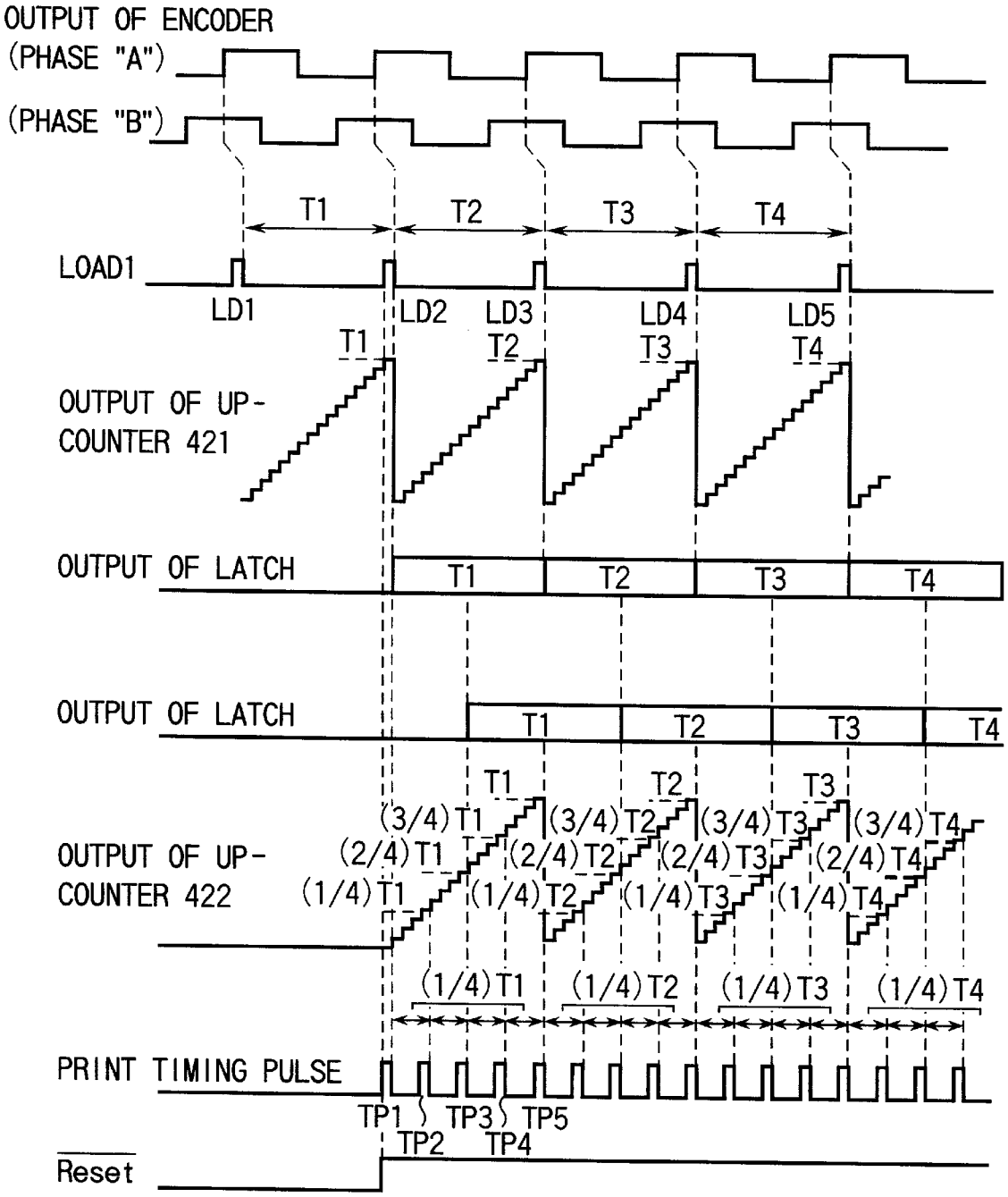
FIG. 4 is a timing waveform diagram showing the operation of a multiplier circuit shown in FIG. 3.

FIG. 4 shows the operation timings of the above components. The up-counter 421 constitutes time measuring means for measuring passage time between adjacent reference points with the reference point set as a starting point by receiving the reference point pulse LOAD1, the passage time measured by the up-counter 421 is latched into the latch circuit 423 and the above operation is repeatedly effected.

Therefore, the latch circuit 423 outputs the passage time between the reference points and updates the passage time each time the reference point pulse LOAD1 is input.

The up-counter 422 starts the time counting operation from the rise of the signal /Reset, supplies Q0 to Q5 among the outputs Q0 to Q7 to the comparator 425, supplies Q0 to Q6 to the comparator 426, and supplies Q0 to Q7 to the comparators 427, 428. Generation of a next timing pulse train is started by setting a coincidence detection output of the comparator 428 as the load signal of the up-counter 422.

The comparator 425 compares the outputs Q0 to Q5 of the up-counter 422 with the outputs Q2 to Q7 of the latch circuit 423. That is, the comparator 425 compares a value equal to ¼ of the measured reference point interval T1 with the value of the up-counter 422 to output a print timing pulse TP2.

The comparator 426 compares the outputs Q0 to Q6 of the up-counter 422 with the outputs Q1 to Q7 of the latch circuit 423. That is, the comparator 426 compares a value equal to ⅔ of the measured reference point interval T1 with the value of the up-counter 422 to output a print timing pulse TP3.

The comparator 427 compares the outputs Q0 to Q7 of the up-counter 422 with outputs of the ¾-divider 429 which causes the outputs Q0 to Q7 of the latch circuit 424 to be ¾. That is, the comparator 427 compares the value equal to ¾ of the measured reference point interval T1 with the value of the up-counter 422 to output a print timing pulse TP4.

The comparator 428 compares the outputs Q0 to Q7 of the up-counter 422 with the outputs Q0 to Q7 of the latch circuit 424. That is, the comparator 428 compares a value equal to the measured reference point interval T1 with the value of the up-counter 422 to output a print timing pulse TP5.

Thus, the up-counter 422 and the comparators 425 to 428 constitute print timing pulse train generating means and divisions of ¼, ⅔ are effected by 2-bit shifting and 1-bit shifting. Further, division of ¾ can be easily attained by a combination of 2-bit shifting and 1-bit shifting.

The latch circuit 424 constitutes print-required time determining means. In this example, the operation for loading a value into the latch circuit 424 is effected by coincidence detection in the comparator 426, the comparators 425, 426 receive the output of the latch circuit 423 as a value to be compared, and the comparators 427, 428 receive the output of the latch circuit 424 as a value to be compared, but this can be freely modified. For example, the output of the latch circuit 423 can be used as a comparison value input to the comparator 427, and in this case, the timing of loading into the latch circuit 424 can be determined by coincidence detection in the comparator 427.

With the above construction, a coincidence detection output is first output from the comparator 428 in synchronism with the reference point pulse LD2 so as to cause a print timing pulse TP1 to be output from the OR gate 434, a coincidence detection output is next output from the comparator 425 at the timing of ¼ of the reference point interval T1 so as to cause a print timing pulse TP2 to be output from the OR gate 434, then a coincidence detection output is output from the comparator 426 at the timing of ⅔ of the reference point interval T1 so as to cause a print timing pulse TP3 to be output from the OR gate 434, a coincidence detection output is next output from the comparator 427 at the timing of ¾ of the reference point interval T1 so as to cause a print timing pulse TP4 to be output from the OR gate 434, and then a coincidence output is output from the comparator 428 at the timing of 4/4 of the reference point interval T1 so as to cause a print timing pulse TP5 to be output from the OR gate 434. At this time, the timing of TP5 does not necessarily coincide with the timing of LD3.

Thus, the up-counter 422 is always re-started while the pulse intervals of the preceding-cycle reference point intervals T1, T2, T3, T4, . . . loaded into the latch circuit 424 are kept and it is always re-started with delay time of the first reference point interval T1 from the reference point pulse. Therefore, it is not forcedly re-started by the reference point pulses LD3, LD4, . . . in or after the third cycle. As a result, there occurs no problem that the interval of the print timing pulses becomes extremely short as in the conventional case. Therefore, the number of divisions of the reference point pulse can be increased, the printing precision can be enhanced and printing can be stably done.

In the above example, a case wherein the reference point pulse LOAD1 is divided by 4 to create a print timing pulse is explained, but if the construction of the divider and the number of the comparators are changed, a print timing pulse whose pulse repetition rate is a given multiple of that of the reference point pulse and which is obtained by dividing the reference point pulse by 2 or 6 can be generated.

Figure 5:
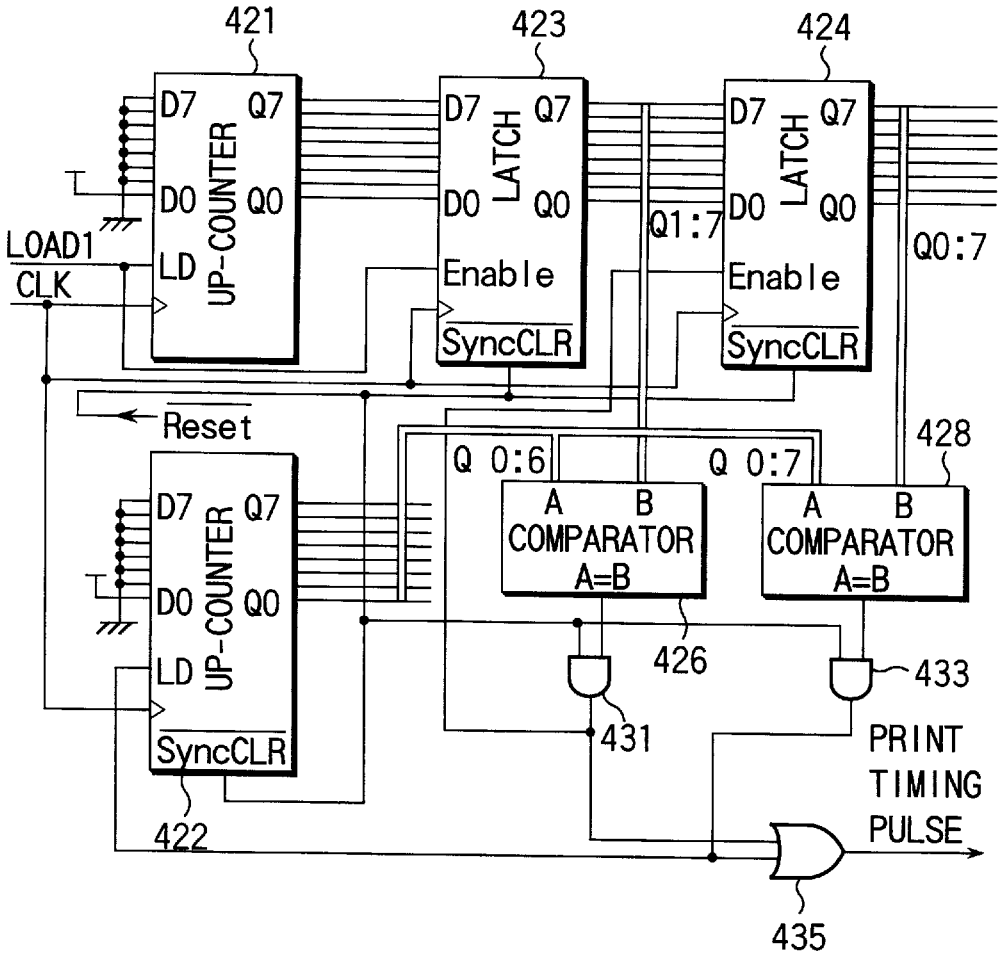
FIG. 5 is a block diagram showing the construction of the multiplier circuit shown in FIG. 1 in a case where the reference point pulse interval is divided into two portions to create print timing pulses.
Figure 6:
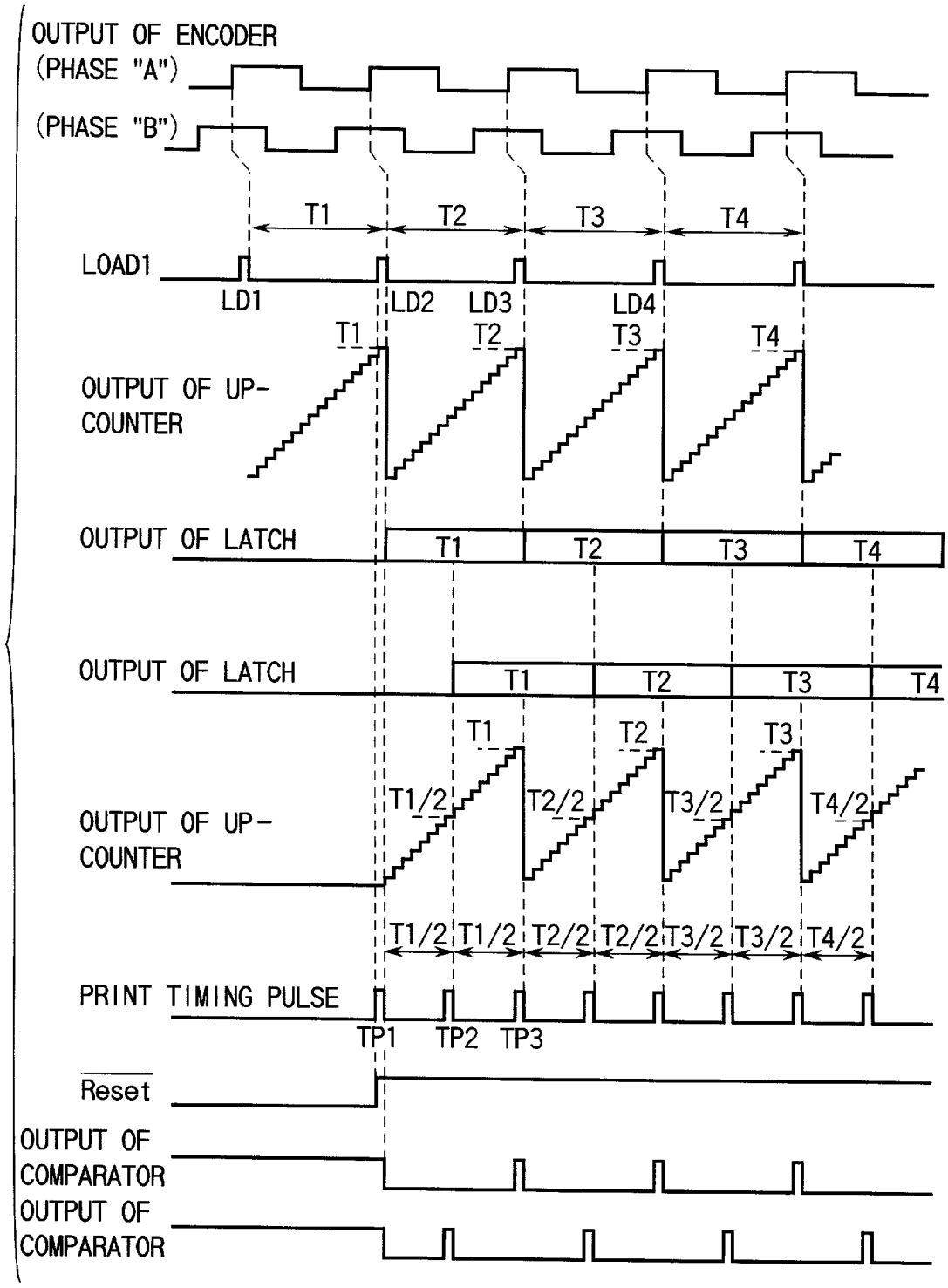
FIG. 6 is a timing waveform diagram showing the operation of a multiplier circuit shown in FIG. 5.

For example, if ½ of the reference point pulse LOAD1 is obtained by division to create a print timing pulse, the construction shown in FIG. 5 is provided and the operation timings of the respective components are as shown in FIG. 6. That is, the comparators 425, 427, ¾ divider 429 and AND gates 430, 432 are omitted and a 2-input OR gate 435 may be used instead of the 4-input OR gate 434.

With the above construction, a coincidence detection output is first output from the comparator 428 in synchronism with the reference point pulse LD2 so as to cause the print timing pulse TP1 to be output from the OR gate 435, next a coincidence detection output is output from the comparator 426 at the timing of ½ of the reference point interval T1 so as to cause the print timing pulse TP2 to be output from the OR gate 435, and then a coincidence detection output is output from the comparator 428 at the timing of ⅔ of the reference point interval T1 so as to cause the print timing pulse TP3 to be output from the OR gate 435. In the case of division of ⅙, the numbers of dividers, comparators, AND gates and the number of inputs to the OR gate may be increased.

Figure 7:
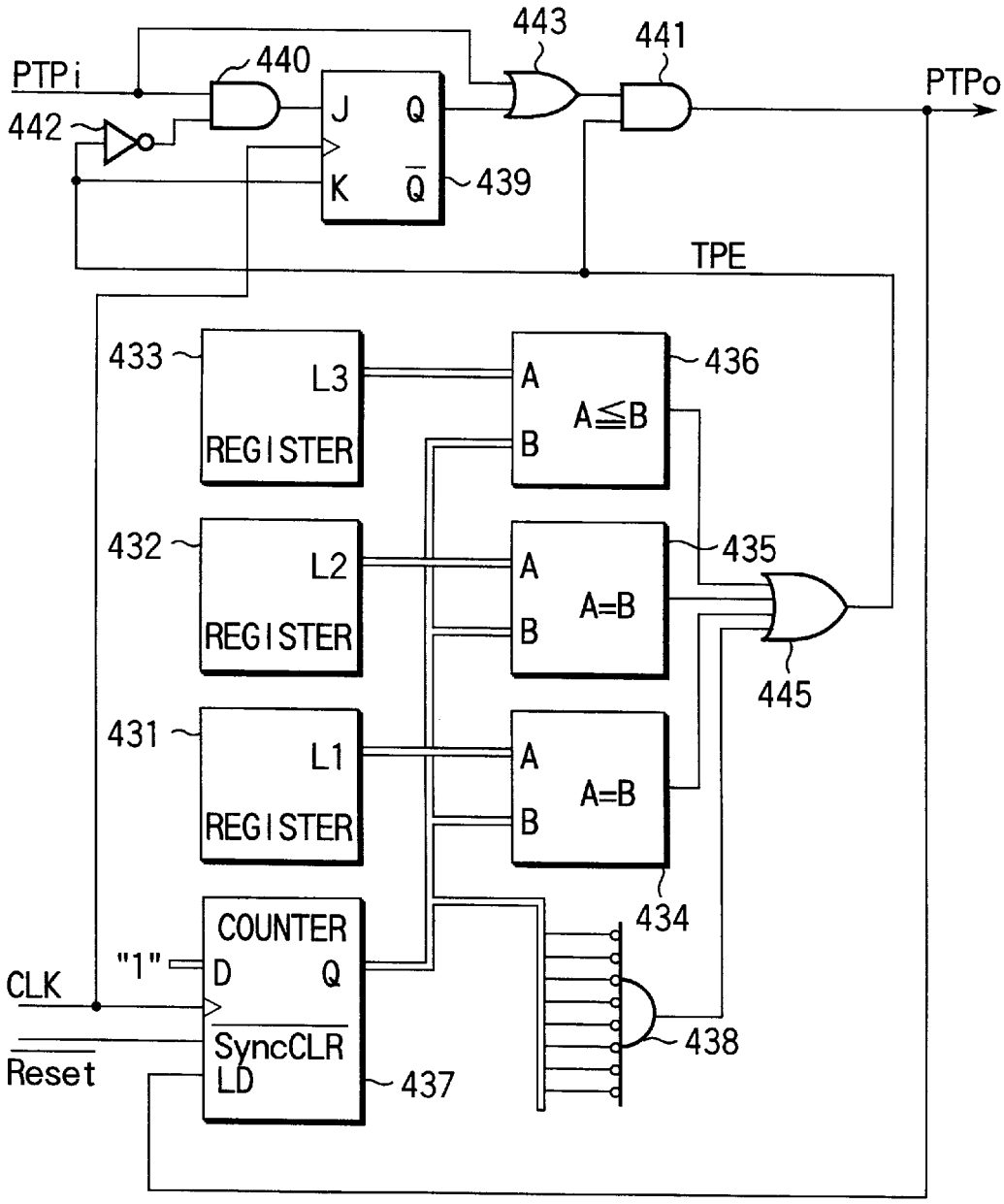
FIG. 7 is a block diagram showing the construction of a print timing correcting circuit shown in FIG. 1.

As shown in FIG. 7, the print timing correction circuit 43 includes three registers 431, 432, 433, three comparators 434, 435, 436, a counter 437 used as a time measuring timer, a zero-detection 8-input NOR gate 438, a JK flip-flop 439, two 2-input AND gates 440, 441, an inverter circuit 442, a 2-input OR gate 443, and a 4-input OR gate 445. A print timing pulse PTPi from the multiplier circuit 42 is input to the AND gate 440 and OR gate 443. The above circuit is a circuit for correcting the input print timing pulse PTPi to meet the driving condition of the ink-jet print head 33.

That is, the print head has an upper limit of the driving frequency in view of the operable frequency range. For example, in the wire dot head, if an attempt is made to effect the printing operation in a period shorter than a period corresponding to the above upper limit driving frequency, next printing is started before the wire is fully returned to the original position so as to cause a problem that the print is made unclear, the impact timing fluctuates, and the wire which is not returned to the original position catches an ink ribbon and is broken in the worst case. Further, in the ink-jet print head, if an attempt is made to effect the printing operation in a period shorter than a period corresponding to the upper limit driving frequency, next printing is started before pressure vibration of ink in the ink chamber is fully suppressed so as to cause a problem that an amount of ejected ink is varied, the ink ejection direction is varied and an air bubble is ejected from the ink-jet nozzle to make it impossible to do printing in the worst case.

The above problems are deeply related to the natural vibration of the head and the pressure vibration in the ink chamber and the phenomenon significantly varies depending on the period of the resonance phenomenon. Therefore, if an attempt is made to drive the print head in a period close to a period corresponding to the upper limit driving frequency, the period in which the print head can be driven takes a discrete value according to the period of the resonance. On the other hand, if the head driving frequency is set low, that is, the driving period is set long, the resonance phenomenon is gradually suppressed and the tops and bottoms of the resonance are suppressed so that the period used for driving can take a continuous value.

In view of the above fact, periods which are close to a period corresponding to the upper limit driving frequency of the ink-jet print head 33 and can be used for printing are set in the registers 431, 432. At this time, a difference between the values in the registers 431 and 432 is generally set to an integer multiple of the period of pressure vibration of the ink-jet print head. The minimum one of the periods in which the resonance phenomenon is suppressed and which can take a continuous value is set in the register 433.

The signal /Reset rises in synchronism with the first print timing pulse PTPi for starting printing. While the signal /Reset is set at the low level, the NOR gate 438 and OR gate 445 are enabled so that the JK flip-flop 439 will be reset. Further, an output TPE of the OR gate 445 which is input to the AND gate 441 is set at the high level and a state in which an input signal PTPi passes through the OR gate 443 and AND gate 441 as it is as an output signal PTPo is set.

When the signal /Reset rises in synchronism with the first print timing pulse PTPi, the PTPo for starting the first printing is output at the same timing as the pulse PTPi. At the same time, the clear state of the counter 437 is released and the counter 437 starts the counting operation. Immediately after the starting of the counting operation, the comparators 436, 435, 434 and the NOR gate 438 are disabled, the OR gate 445 is disabled and the AND gate 441 is closed.

After this, if the count of the counter 437 coincides with the value L1 of the register 431, that is, if time L1 has elapsed after the pulse PTPo was output, the comparator 434 is enabled to output a pulse to the AND gate 441 via the OR gate 445. However, since the OR gate 443 is not enabled if a next pulse PTPi is not input in a period up to the present time, the AND gate 441 is not enabled. Therefore, at this time, the pulse PTPo is not output.

Then, if a next reference point is reached and a next pulse PTPi is input, the OR gate 443 is enabled, and at the same time, the JK flip-flop 439 is set and the enabled state of the OR gate 443 is maintained. However, at this time, if none of the comparators 434, 435, 436 is enabled, the OR gate 443 is not enabled, and therefore, the AND gate 441 is also disabled and the pulse PTPo is not output.

If time further passes and the count of the counter 437 coincides with the value L2 of the register 432, that is, if time L2 has elapsed after the first print timing pulse PTPi was input, the OR gate 445 is enabled. At this time, since the enabled state of the OR gate 443 is maintained, the AND gate 441 is enabled to output a second print timing pulse PTPo. At the same time, the Jk flip-flop 439 is cleared. Further, the counter 437 is loaded with "1" and starts the new counting operation.

Figure 8:
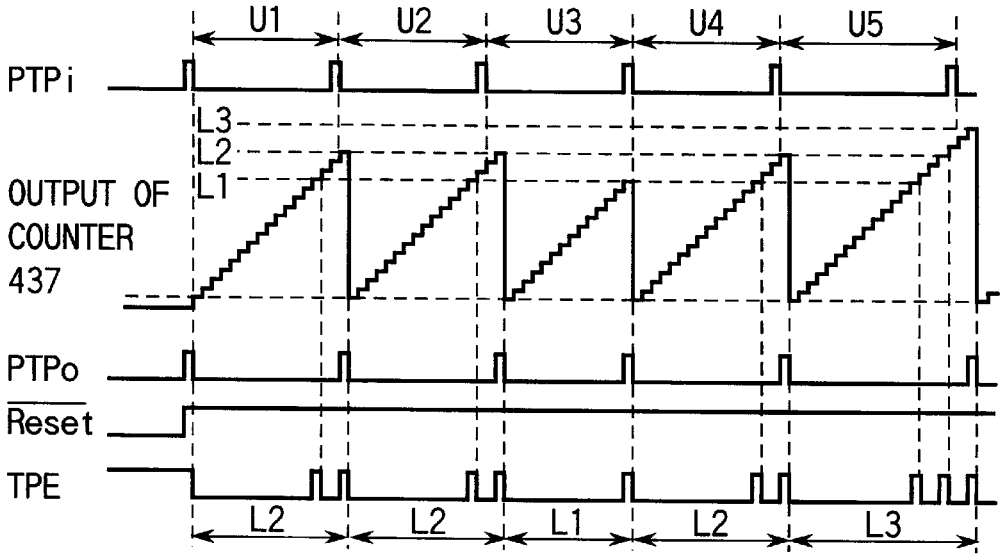
FIG. 8 is a timing waveform diagram for illustrating the operation of the print timing correcting circuit shown in FIG. 7.

The print timing correction circuit 43 effects the above operation to correct the pulse interval for the print timing pulse PTPo supplied to the head drive circuit 37 to such a value that the input pulse PTPi will be set equal to the value L1 in the register 431, equal to the value L2 in the register 432 or equal to or larger than the value L3 in the register 433. That is, as shown in FIG. 8, the intervals of the print timing pulses PTPo output with respect to the intervals U1, U2, U3, U4, U5 of the input print timing pulses PTPi are set to L2, L2, L1, L2, L3, for example.

Thus, the correcting operation can be attained by taking the response performance of the ink-jet print head into consideration and the head operation can be stably effected at the most preferable response speed, and as a result, the printing quality can be enhanced and the high-speed printing can be attained.

Since the value selected from the values of the registers 431, 432, 433 is determined according to the input timing of the pulse PTPi, the output pulse PTPo becomes a pulse which follows the pulse PTPi on average. For example, when the pulse interval for the input pulse PTPi is short, the pulse interval for the output pulse PTPo is continuously set in the state of L1, the pulse interval for the output pulse PTPo is changed from the mixed state of L1 and L2 to the state of L2 as the pulse interval for the input pulse PTPi becomes longer, then the pulse interval for the output pulse PTPo is automatically changed from the mixed state of L2 and L3 to the state of L3 and to a value exceeding L3, and thus the output pulse PTPo follows the pulse PTPi on average.

The print timing correction circuit 43 waits for inputting of the print timing pulse PTPi and corrects the pulse to start printing at the timing at which the printing can be done and which comes earliest after the present time. Therefore, at least the intervals of the fist print timing pulse PTPo and the second print timing pulse PTPo always become longer than the interval of the input pulses PTPi.

If the precision of the printing result is strictly required, the signal /Reset may be raised at the timing earlier than the actual print starting timing and print data may be processed to print the space with the output pulse PTPo output in the thus created period of time.

Thus, the requirement for setting the interval to L1, L2 or a value larger than L3 which is the constraint condition of the driving period of the ink-jet print head 33 and the requirement for causing the print timing pulse PTPo to follow the print timing pulse PTPi which conflict with each other can be both satisfied.

Figure 9:
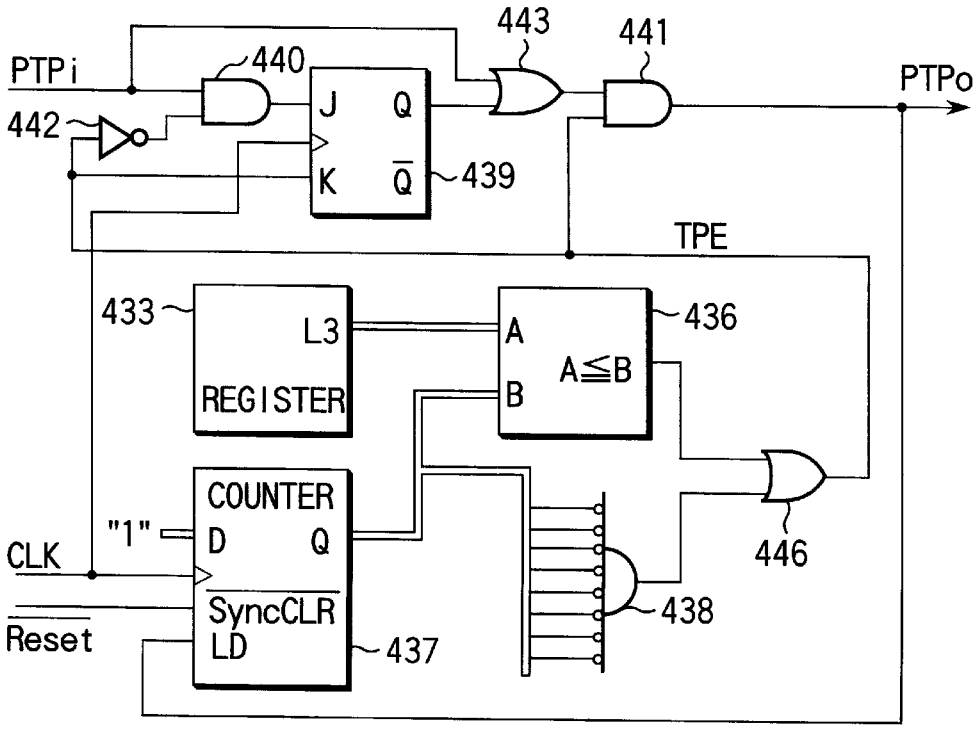
FIG. 9 is a block diagram showing a modification of the print timing correcting circuit shown in FIG. 7.

If the constraint condition is simplest, the registers 431, 432, the comparators 434, 435 may be omitted as shown in FIG. 9. In this case, whether the interval for the print timing pulse PTPi is larger than the value L3 of the register 433 or not is simply determined, the print timing pulse PTPi is used as the print timing pulse PTPo as it is if the interval is equal to or larger than the value L3, and a pulse delayed until time of the value L3 has elapsed is output as the print timing pulse PTPo if the interval is smaller than L3.

If the interval of the print timing pulse PTPi is smaller than the value L3 of the register 433 and it is delayed until time of the value L3 has elapsed, the counter 437 starts the next counting operation with the delayed pulse set as a starting point, and therefore, the next pulse interval is determined based on the condition that it is equal to or larger than the value L3. However, since the delay amount is accumulated, the average time interval for the input print timing pulse PTPi must be longer than time determined by L3. If the average time interval for the print timing pulse PTPi is longer than time determined by L3, delay can be compensated for when the time interval for the pulse PTPi becomes shorter even if delay temporarily occurs, and the control operation can be prevented from being made impossible.

Figure 39:
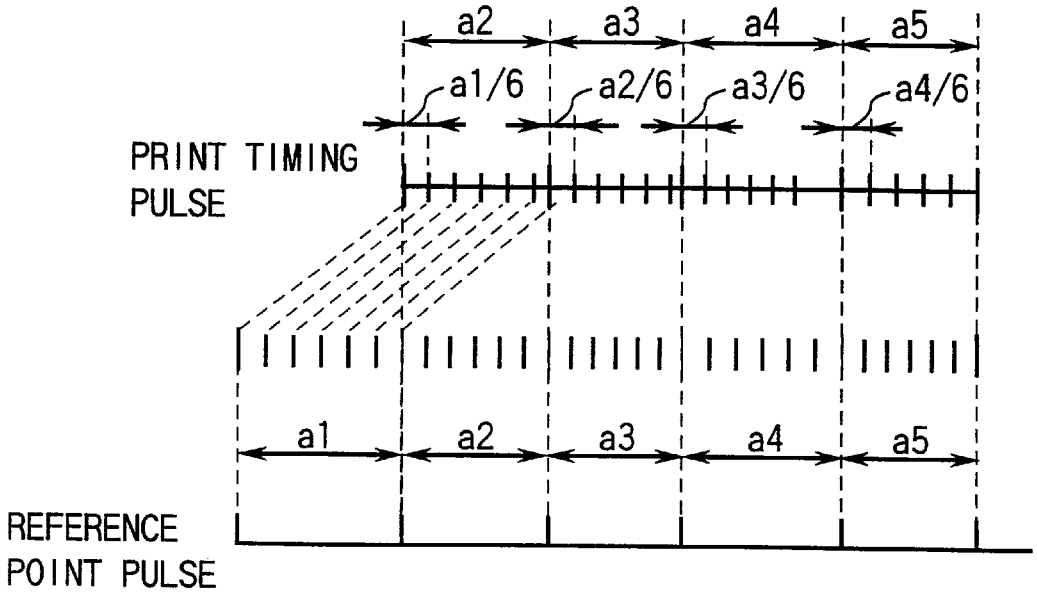
FIG. 39 PRIOR ART
FIGS. 39 and 40 are timing waveform diagrams for illustrating the conventional problem.
Figure 40:
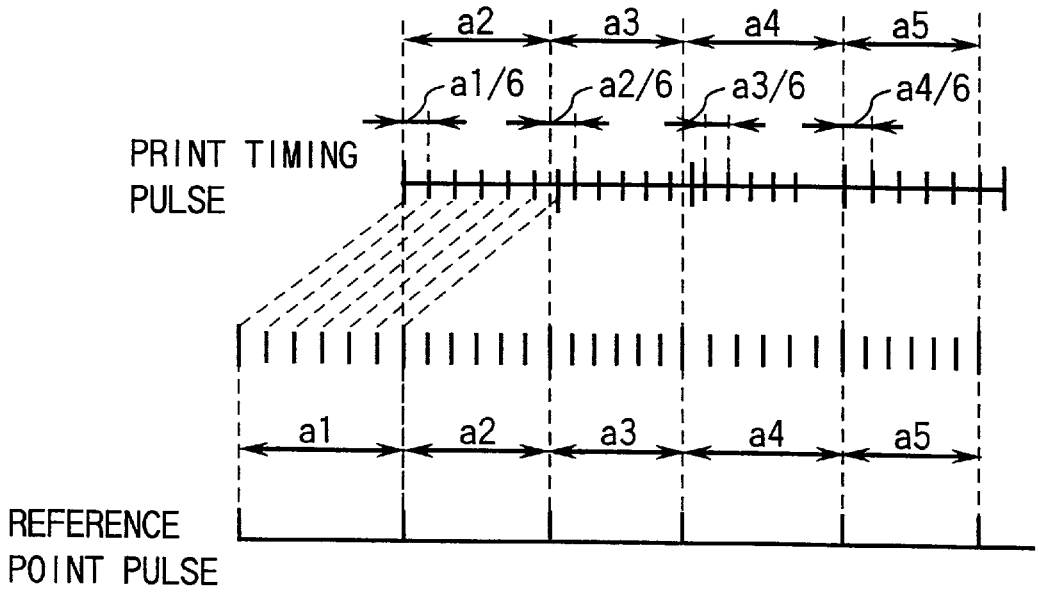
FIG. 40 PRIOR ART

In this embodiment, the reference point pulse LOAD1 from the reference point pulse generating circuit 41 is multiplied by ⅙, ¼, ½ at the multiplier circuit 42 to create a print timing pulse PTPi, the pulse is corrected by the print timing correction circuit 43 and the corrected pulse is supplied to the head drive circuit 37 as the print timing pulse PTPo, but the function of the multiplier circuit 42 and the function of the print timing correction circuit 43 are independent from each other and the above case is not limitative. That is, if the pulse interval for the print timing pulse PTPi is always longer than the driving period corresponding to the upper limit of the driving frequency of the ink-jet print head 33, the print timing pulse correction circuit 43 can be omitted. Further, a conventional multiplier circuit can be used as the above multiplier circuit and an output thereof may be input to the print timing pulse correction circuit 43. In this case, even if the multiplier circuit partially generates a pulse of short period as shown in FIGS. 39, 40, the period of the pulse is corrected and made longer to such a value as to make the printing possible by the function of the print timing correction circuit 43 and thus a pulse PTPo is output. Further, if the reference point pulse LOAD1 from the reference point pulse generating circuit 41 is used as it is as the print timing pulse, the multiplier circuit 42 can be omitted. If the precision of rotation of the rotary drum 31 is high, a timer circuit 45 as indicated by broken lines is provided instead of the rotary encoder 36, waveform shaping circuit 40, reference point pulse generating circuit 41 and multiplier circuit 42 and it is possible to generate a print timing pulse from the timer circuit 45 and supply the same to the print timing pulse correction circuit 43. In this case, the print timing pulse correction circuit 43 serves as a circuit for selectively setting the print period to the value of L1 or L2 in which printing can be done if the print timing pulse PTPi supplied from the timer circuit 45 is set at a value between the value L1 of the register 431 of FIG. 7 and the value L2 of the register 432, for example.

Next, a printer control apparatus according to a second embodiment of this invention is explained with reference to the accompanying drawings.

Components which are the same as those explained in the first embodiment are denoted by the same reference numerals and only different components are explained.

Figure 10:
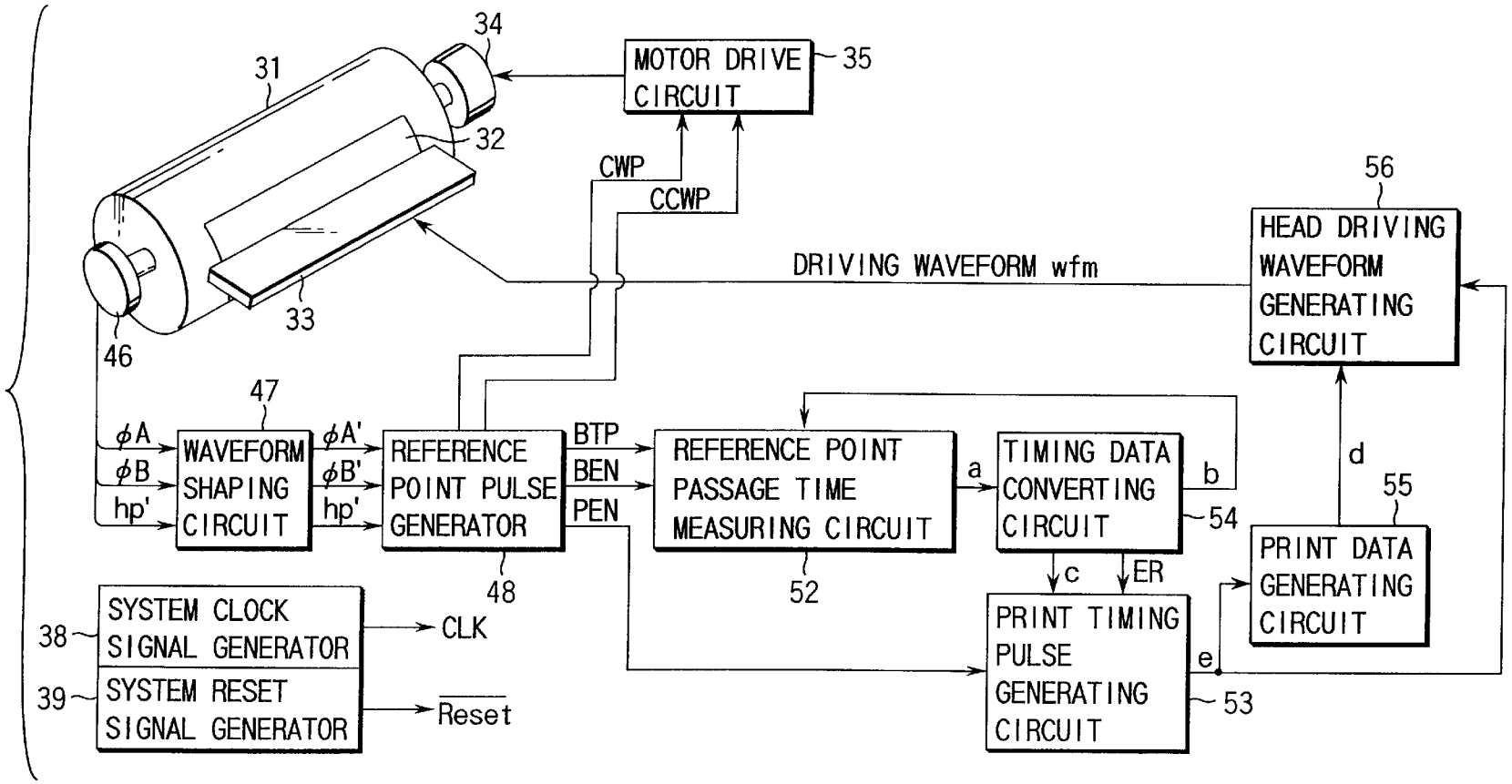
FIG. 10 is a block diagram of a printer control apparatus according to a second embodiment of this invention.

As shown in FIG. 10, the rotation speed of a rotary drum 31 is detected by a rotary encoder 46 which in turn supplies a home position detecting signal hp and 2-phase timing pulses ϕA, ϕB to a waveform shaping circuit 47. The basic construction of the rotary encoder 46 is the same as that of the rotary encoder 36. A variation in the rotation speed of the rotary drum 31 is suppressed to within +13% and −11% with respect to 200 rpm. This corresponds to the rotation speed of 178 rpm to 227 rpm. Further, this corresponds to 559.8 μs to 439.8 μs in terms of the passage time between the slits.

The home position detecting signal hp is output at one specified portion on the rotary drum 31, and therefore, the timing at which the ink-jet print head 33 has reached a position to be printed on the printing paper 32 can be determined by detecting the timing of the home position detecting signal hp and then counting the encoder pulse.

The waveform shaping circuit 40 eliminates noises from the home position detecting signal hp and timing pulses ϕA, ϕB and binary-codes them to supply a binary-coded home position detecting signal hp' and timing pulses ϕA', ϕB' to a next-stage reference point pulse generating circuit 48.

Figure 11:
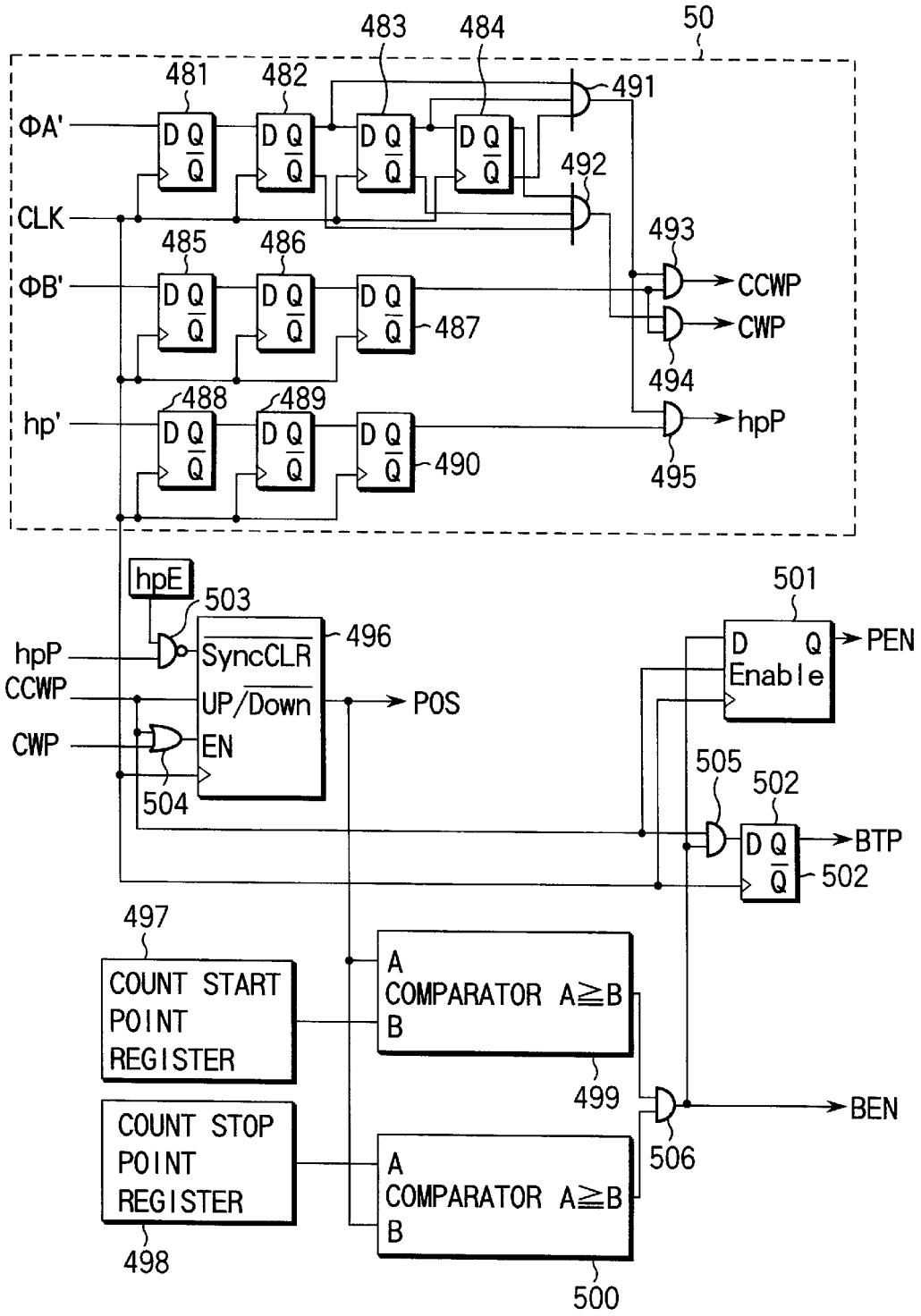
FIG. 11 is a block diagram showing the construction of a reference point pulse creation circuit shown in FIG. 10.

The reference point pulse generating circuit 48 has a construction as shown in FIG. 11. That is, a rotation detector 50 is constructed by ten D-type flip-flops 481, 482, 483, 484, 485, 486, 487, 488, 489 and 490 connected in four stages, three stages and three stages, two 3-input AND gates 491, 492, and three 2-input AND gates 493, 494, 495. Further, the reference point pulse generating circuit 48 includes a 600-scale up/down-counter 496, measurement start position register 497, measurement stop position register 498, two comparators 499, 500, D-type flip-flop 501 with Enable terminal, D-type flip-flop 502, 2-input NAND gate 503, 2-input OR gate 504 and two 2-input AND gates 505, 506.

The 4-stage flip-flops 481 to 484 and AND gates 491, 492 constitute an edge detecting circuit for detecting rise and fall edges of the timing pulse ϕA'. The reason why the 4-stage flip-flops 481 to 484 are used is to eliminate the metastable state of the flip-flop when the timing pulses ϕA' is synchronized with CLK and the flip-flop 481 samples the timing pulse ϕA' and eliminate subtle chattering occurring at the rise time.

In the rotation detector 50, if the timing pulse ϕB' is at the high level when the timing pulse ϕA' rises, the AND gate 493 is enabled and it is detected that the rotary drum 31 rotates in a CCW direction, and if the timing pulse ϕB' is at the high level when the timing pulse ϕA' falls, the AND gate 494 is enabled and it is detected that the rotary drum 31 rotates in a CW direction.

Printing is done while the rotary drum 31 is rotated in the CCW direction. It is necessary to detect the rotation in the CW direction so as not to lose the position of the rotary drum 31 even if the rotary drum 31 vibrates in the rotation direction at the starting time and stop time, but if the counting operation is started with the home position detecting signal hp' used as a starting point in each cycle, the rotation detector in the CW direction can be omitted. The home position detecting signal hp is sampled once at the rise time of the timing pulse ϕA in each rotation of the rotary drum 31.

The 3-stage flip-flops 485, 486, 487 and 488, 489, 490 are provided to detect the rise edge of the timing pulse ϕA and adjust the delay amount thereof, but they can be omitted by using the system clock CLK since it has a sufficiently high frequency. A pulse CCWP output from the AND gate 493 and a pulse CWP output from the AND gate 494 are also supplied to the motor drive circuit 35 and used as a control signal for controlling the constant-speed driving of the motor 34. It is not necessary to supply the pulses CCWP and CWP to the motor drive circuit 35 if a synchronous motor such as a stepping motor is used as the motor 34.

The up/down-counter 496 effects the up-counting operation and down-counting operation in response to the pulses CCWP and CWP, respectively. The counter 496 is a 10-bit binary counter and is automatically loaded with "0" when it is counted up from the value "599" and loaded with "599" when it is counted down from the value "0". The counter 496 is initialized once when the power supply switch is turned ON.

In the initialization, a pulse is output to hpP at one position somewhere on the circumference of the rotary drum 31 if the rotary drum 31 is rotated by one rotation or more while an hpP terminal is kept at the high potential level, and at this time, the counter 496 is cleared to "0". Then, the hpP terminal is returned to the low potential level. After this, the counter 496 always indicates the absolute position of the rotary drum 31 with the home position hp set as the starting point. Since the ink-jet print head 33 is fixed, the value can be converted into a relative position between the printing paper 32 and the ink-jet print head 33.

The home position hp is set at a position indicating that the ink-jet print head faces a region outside of the printing paper 32, that is, a region exposed between the front and rear ends of the printing paper 32. Therefore, the count of the counter 496 monotonously increases while relative movement of the ink-jet print head 33 from the front end to the rear end of the printing paper 32.

The count start point register 497 stores a count of the counter 496 representing a position where the measurement for printing is started, and the count stop point register 498 stores a count of the counter 496 representing a position where the measurement for printing is stopped. A signal BEN is created to indicate the measurement range by the comparators 499, 500 and AND gate 506.

While the signal BEN is kept at the high level, the AND gate 505 is enabled if the pulse CCWP exists and then a reference point pulse BTP is output after one clock. The flip-flop 501 with Enable terminal is set at the same time as generation of the first reference point pulse BTP and a signal PEN indicting a printing period is output.

Figure 12:
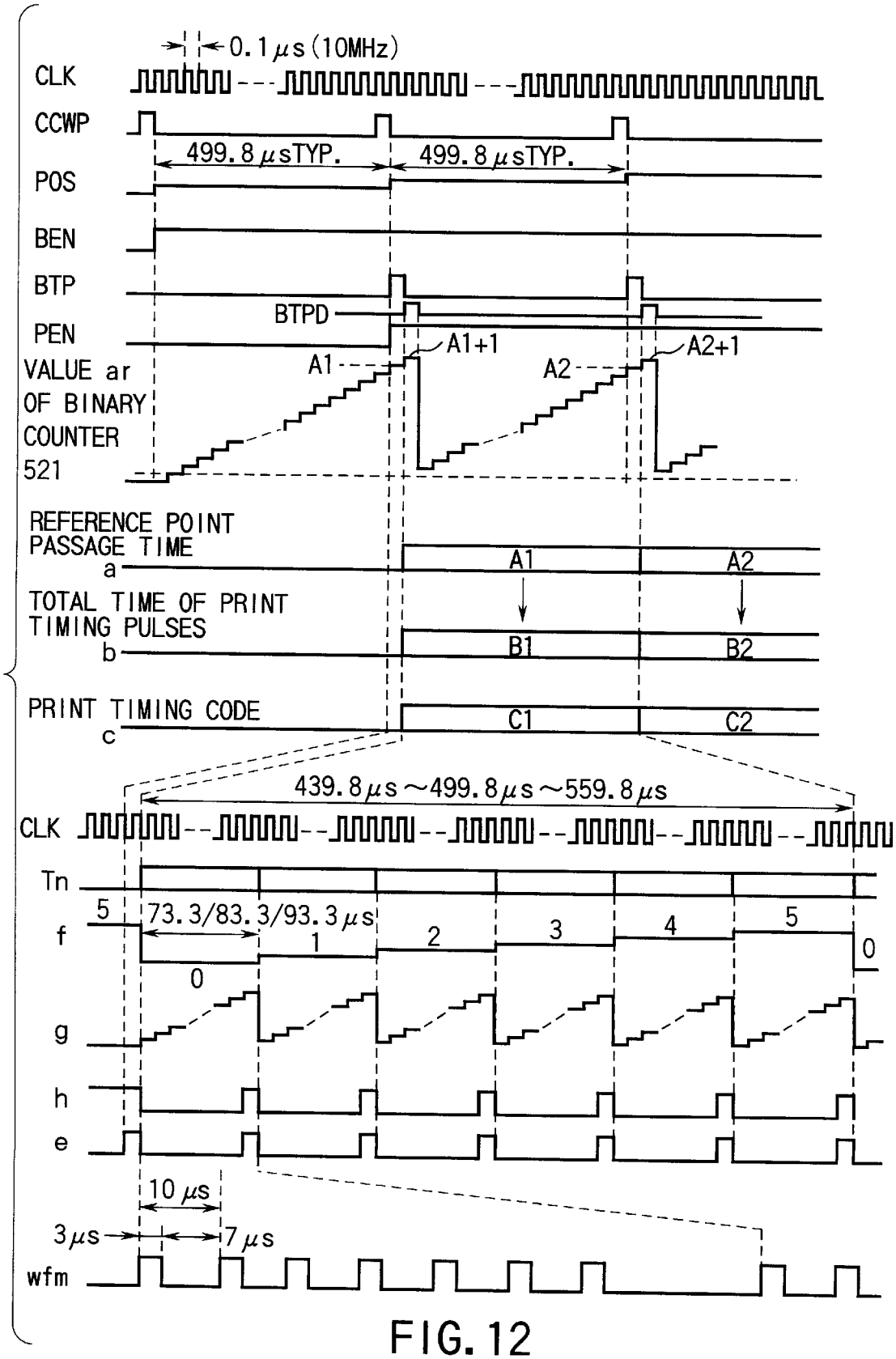
FIG. 12 is a timing waveform diagram showing the operation of the printer control apparatus shown in FIG. 10.

The above operation is illustrated by the timing waveforms shown in the upper part of FIG. 12.

Figure 13:
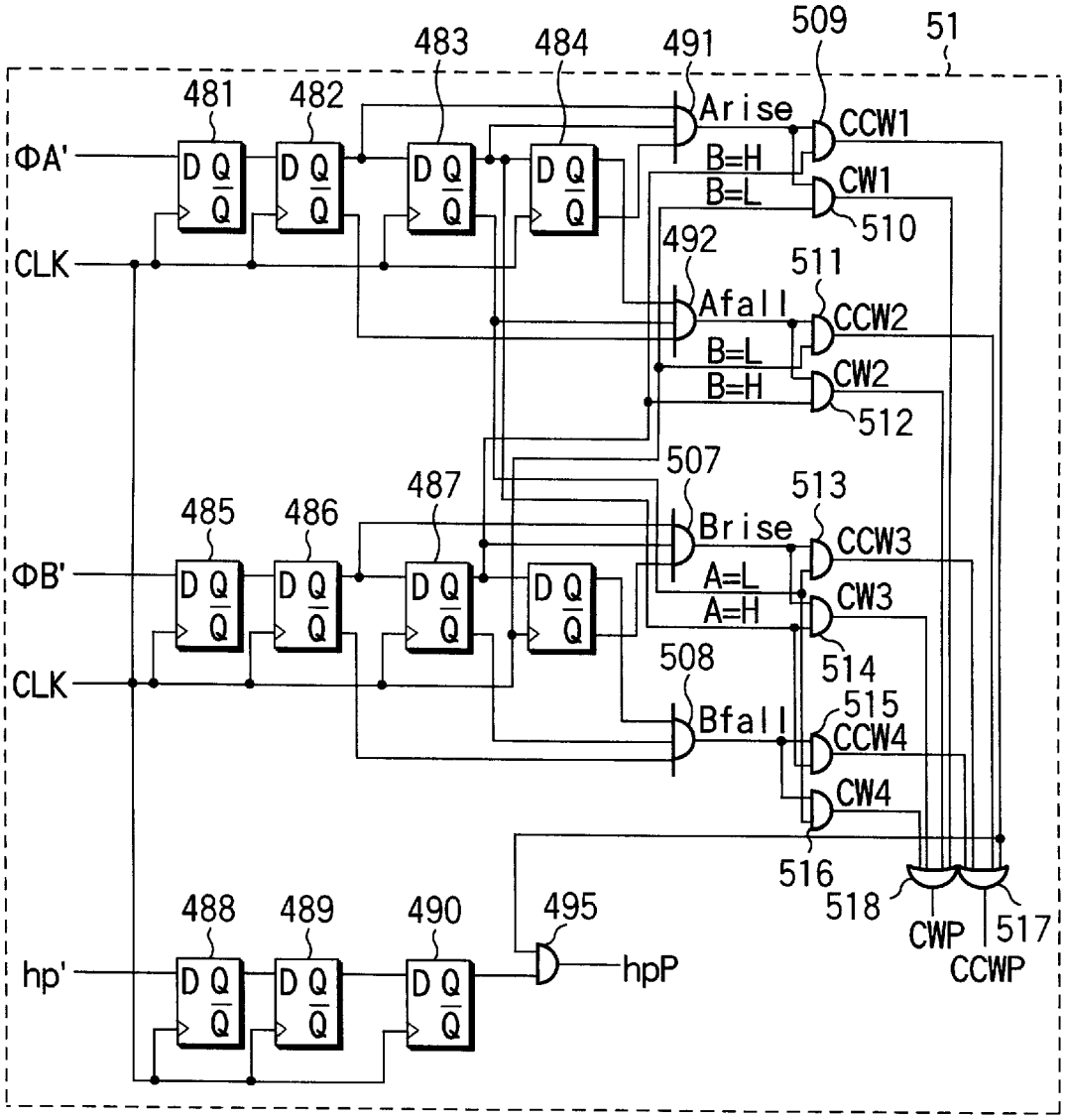
FIG. 13 is a block diagram showing another example of the construction of a rotation detector shown in FIG. 11.

The rotation detector 50 is a detecting circuit for deriving CCWP of 600 pulses which are the same in number as the number of slits from the rotary encoder 46 having 600 slits on one round and this portion can be replaced by a multiplier circuit 51 shown in FIG. 13. In order to derive CCWP of 600 pulses on one round by use of the circuit, an encoder having 150 slits on one round is used as the rotary encoder. The circuit uses 3-input AND gates 507, 508, 2-input AND gates 509, 510, 511, 512, 513, 514, 515, 516 and 4-input OR gates 517, 518 instead of the AND gates 493, 494, 495.

Figure 14:
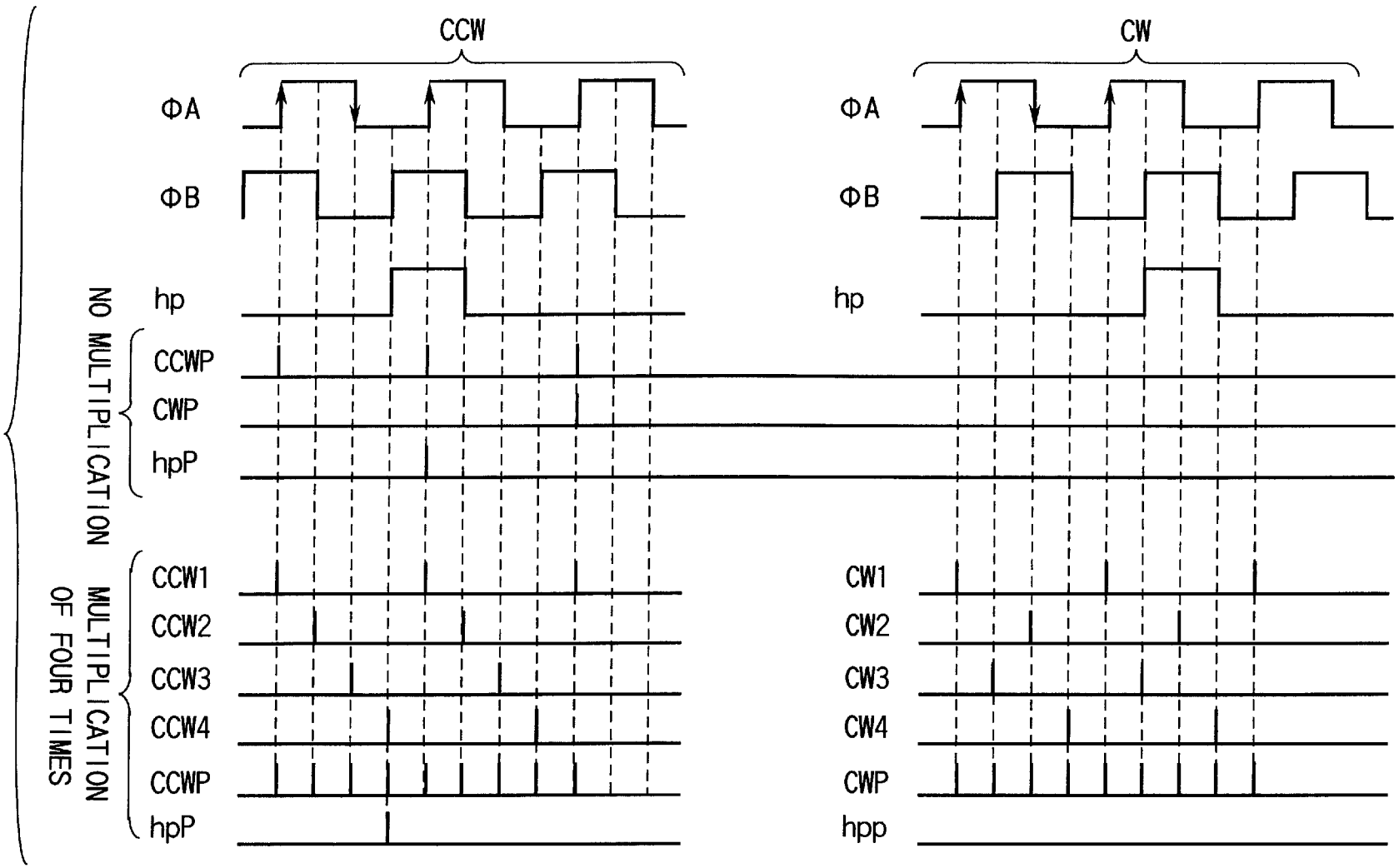
FIG. 14 is a timing waveform diagram showing the operations of the rotation detectors shown in FIGS. 11 and 13 as compared with each other.

FIG. 14 shows the operations of the rotation detectors 50 and 51 shown in FIGS. 11 and 13 as compared with each other. The pulses CCWP, CWP, hpP without multiplication are the waveforms of the rotation detector 50 and the pulses CCW1, CCW2, CCW3, CCW4, CCWP, hpP with multiplication of four times are the waveforms of the rotation detector 51.

In the rotation detector 50, the rotation is detected only at the edge of the timing pulse $\phi$A when the timing pulse $\phi$B is set at the high level, but in the rotation detector 51, the rotation is detected at both edges of each timing pulse $\phi$A, $\phi$B when the timing pulse of the other phase is set at the high level/low level, and therefore, the resolution which is four times the resolution of the above case can be obtained if the same rotary encoder is used.

The reference point pulse BTP and signal BEN from the reference point pulse generating circuit 48 are supplied to the reference point passage time measuring circuit 52 and the signal PEN is supplied to the print timing pulse generating circuit 53. The reference point passage time measuring circuit 52 measures the time interval between the reference point pulses based on the signals BTP, BEN and supplies the measurement value a to the timing data converting circuit 54.

The timing data converting circuit 54 outputs print timing total time b and print timing code c based on the measurement value a, feeds the print timing total time b back to the reference point passage time measuring circuit 52 and supplies the print timing code c to the print timing pulse generating circuit 53. Further, the timing data converting circuit 54 supplies an error output ER to the print timing pulse generating circuit 53 when the measured value a lies outside a preset range. The print timing pulse generating circuit 53 generates a print timing pulse e at an interval according to the value of the print timing code c from the timing data converting circuit 54.

Next, the functions of the reference point passage time measuring circuit 52, print timing pulse generating circuit 53 and timing data converting circuit 54 are explained with reference to FIG. 15. In the multiplier circuit 42 in the first embodiment, as shown in FIG. 2, the values a1', a2', a3', a4', a5', . . . each of which is derived by adding intervals between the print timing pulses starting from the reference point pulse BP2 for every six pulses coincide with intervals a1, a2, a3, a4, a5, . . . between the pulses starting from the reference point pulse BP1 which occurs one cycle before the reference point pulse BP2.

Figure 15:
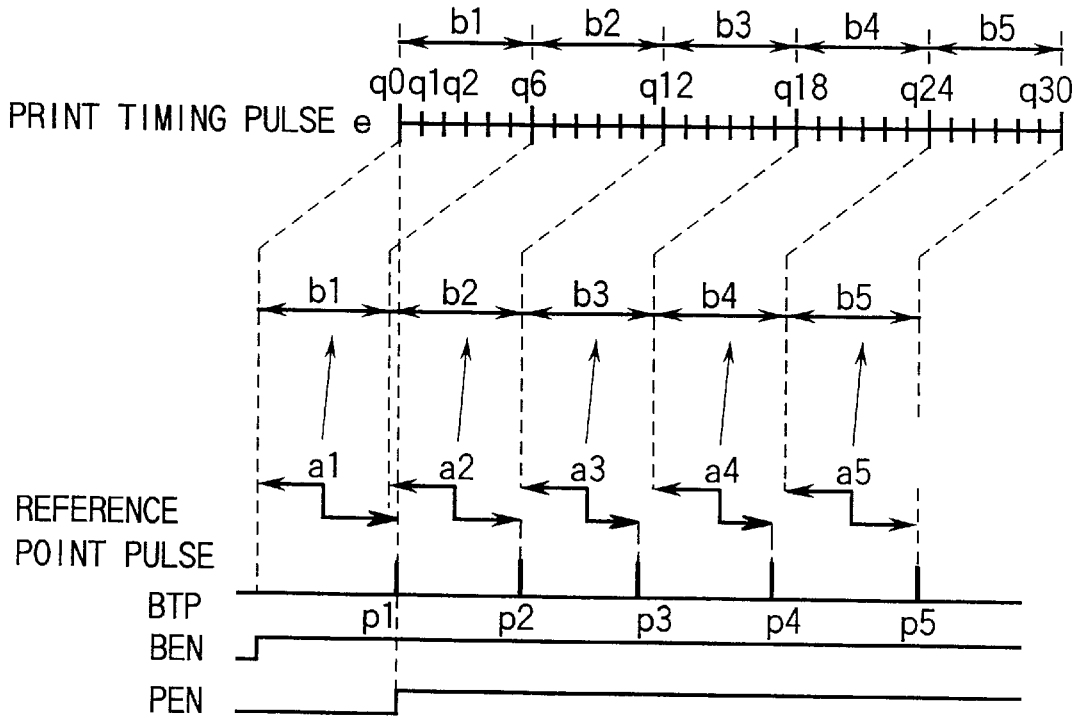
FIG. 15 is a timing waveform diagram for illustrating the functions of a reference point passage time measuring circuit, print timing pulse generating circuit and timing data converting circuit shown in FIG. 10.

On the other hand, in the case of FIG. 15, total values b1, b2, b3, b4, b5, . . . each of which is derived by adding intervals between the print timing pulses e for every six pulses are determined depending on the timings of the reference point pulses BTP (p1, p2, p3, p4, p5, . . . ), but they do not always coincide with the intervals of the reference point pulses.

Time measured by the reference point passage time measuring circuit 52 is set to a1, a2, a3, a4, a5, . . . . The first value a1 is a time interval from the rise of the signal BEN indicating the measurement period to the first reference point pulse p1 and coincides with the time interval corresponding to one slit of the rotary encoder 46. The positions of print timing pulses q1 to q6 are determined with respect to the value a1 so that the total value b1 of the time intervals between the print timing pulses q1, q2, q3, q4, q5, q6 will be set closer to the value a1.

Figure 16:
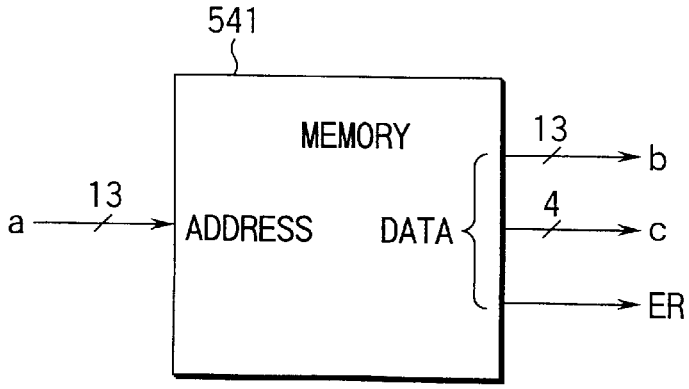
FIG. 16 is a block diagram showing the construction of a memory provided in the timing data converting circuit shown in FIG. 10.
Figure 17:
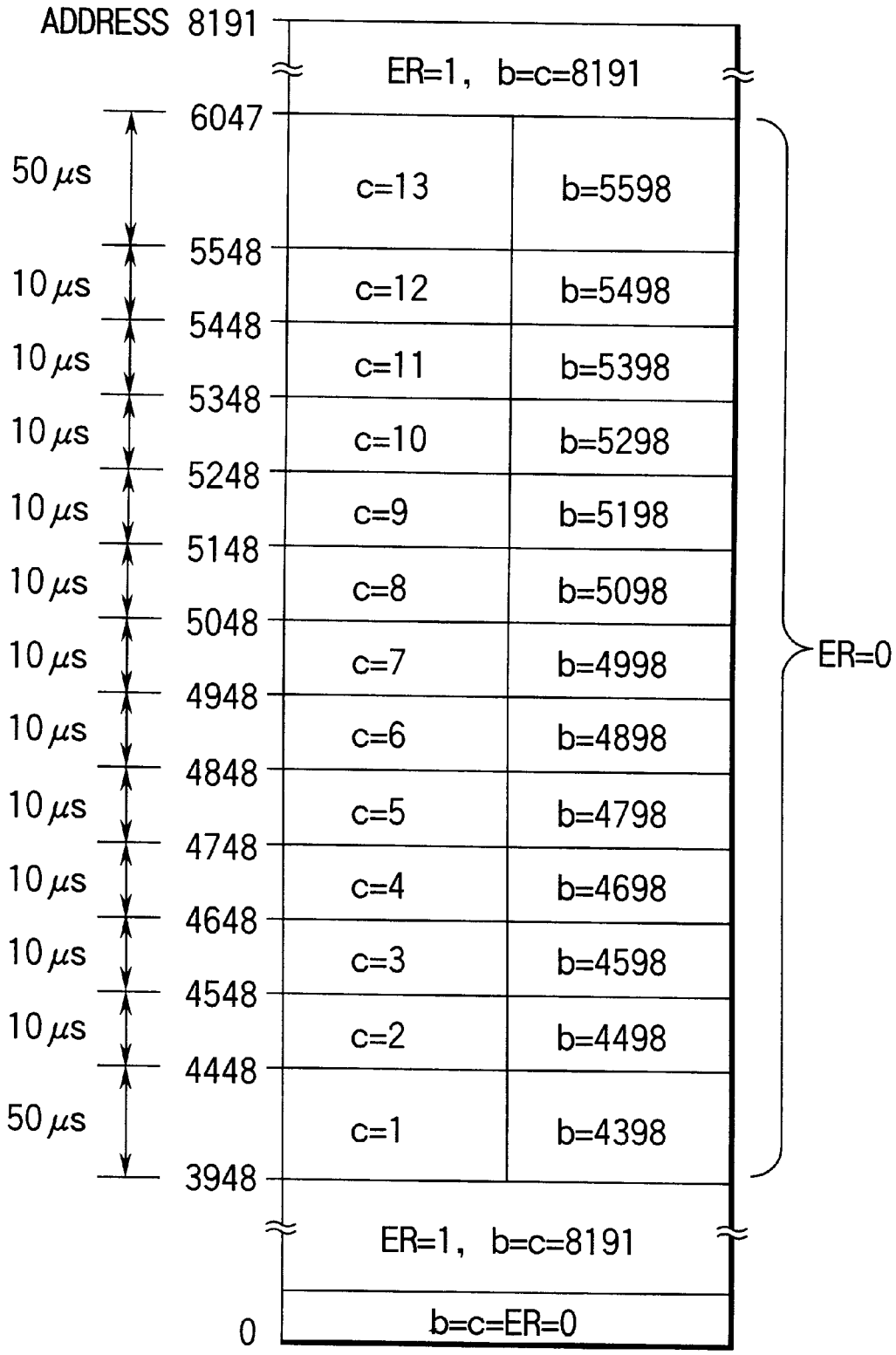
FIG. 17 is a diagram showing one example of a table provided in the memory shown in FIG. 16.
Figure 18:
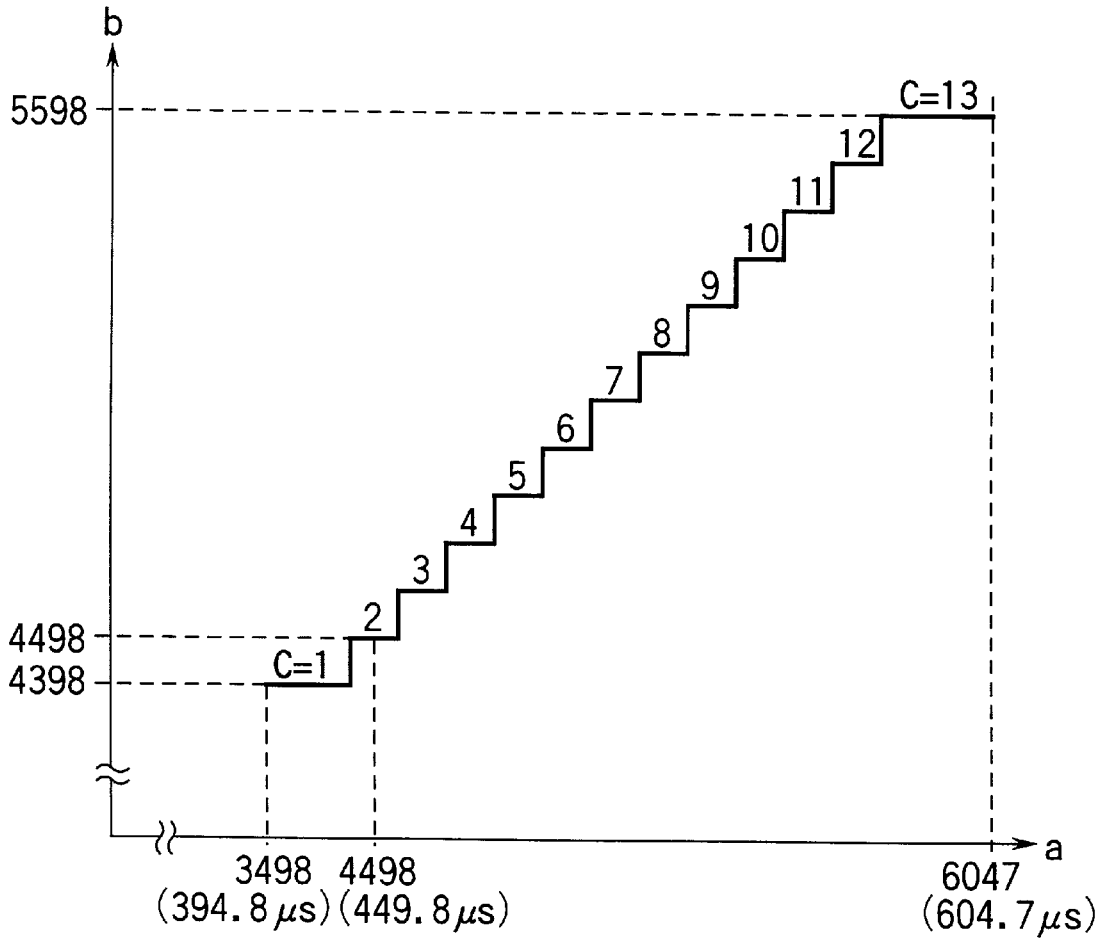
FIG. 18 is a graph for illustrating data stored in the table shown in FIG. 17.

The above determination is made based on values in the table provided in the print timing pulse generating circuit 53 and the table in the memory 541 provided in the timing data converting circuit 54 shown in FIG. 16. One example of the table provided in the memory 541 is shown in FIG. 17. The concept of data stored in the table is shown by a graph in FIG. 18.

The printing timing total time b takes discrete values of 13 stages with respect to a continuous value of the reference point passage time a. Print timing codes c=1 to 13 are assigned to the respective stages. The print timing total time b has the lower limit of 4398 (439.8 $\mu$s) and the upper limit of 5598 (559.8 $\mu$s) and is set in a correspondence relation having saturated values corresponding to the reference point passage time a in a wider range in the upper limit and lower limit than in the intermediate portion. That is, a corresponding width of a value 100 (10 $\mu$s) is set in each of the stages from the second stage to the twelfth stage and a corresponding width of a value 500 (50 $\mu$s) is set in each of the first stage of the lower limit and the thirteenth stage of the upper limit.

The above values are set because the printing operation may be continuously effected for some period of time in a period to the upper or lower limit even when the interval of the reference point pulse exceeds a range of the time interval corresponding to an adequate period for head driving and the interval of the reference point pulse can be set back to the correct range. Further, the upper limit of the print timing total time b can be omitted since the print period tends to become longer in this range, but if an extremely long period occurs, an extremely short period may be caused to appear later, and therefore, the upper limit may be preferably provided so as not to accumulate deviations. If the reference point passage time a is larger than the upper limit value 6047 (604.7 $\mu$s) or smaller than the lower limit value 3948 (394.8 $\mu$s), ER=1 is set to notify an error state where the printing is inadequate.

One example of the print timing pulse generating circuit 53 is shown in FIG. 19.

The value a1 and the value b1 do not always coincide with each other. This is because the value a1 indicates the rotation speed of the rotary drum 31 and the value b1 places the restriction on the pulse interval according to the characteristic of the ink-jet print head 33 and a value of the table which is close to the value a1 but is not always equal to the value a1 is given as the value b1. Therefore, the pulse intervals after the print timing pulse q6 must be determined so as to correct a deviation between a1 and b1.

The next value a2 measured by the reference point passage time measuring circuit 52 is measured as follows instead of measuring the passage time between the pulses p1 and p2 of the reference point pulse. That is, the passage time from the rise of the signal BEN indicating the measurement period is accumulated, the total time b1 of six intervals between the print timing pulses q0 to q6 determined at the timing of the reference point pulse p1 is subtracted, then the passage time until the reference point pulse p2 is reached is accumulated and the value a2 obtained at this time is set as the second reference point passage time. The value is shown by the interval a2 in FIG. 15.

The six intervals between the next print timing pulses q6 to q12 and the total value b2 thereof are determined based on the above value according to the table of FIG. 17 and the table of FIG. 19. By effecting the above process, the pulse intervals between the print timing pulses q0, q1, . . . follow the constraint condition of the ink-jet print head 33 defined in the table, but at the same time, the pulse intervals follow the reference point pulses p1, p2, p3, . . . .

Figure 20:
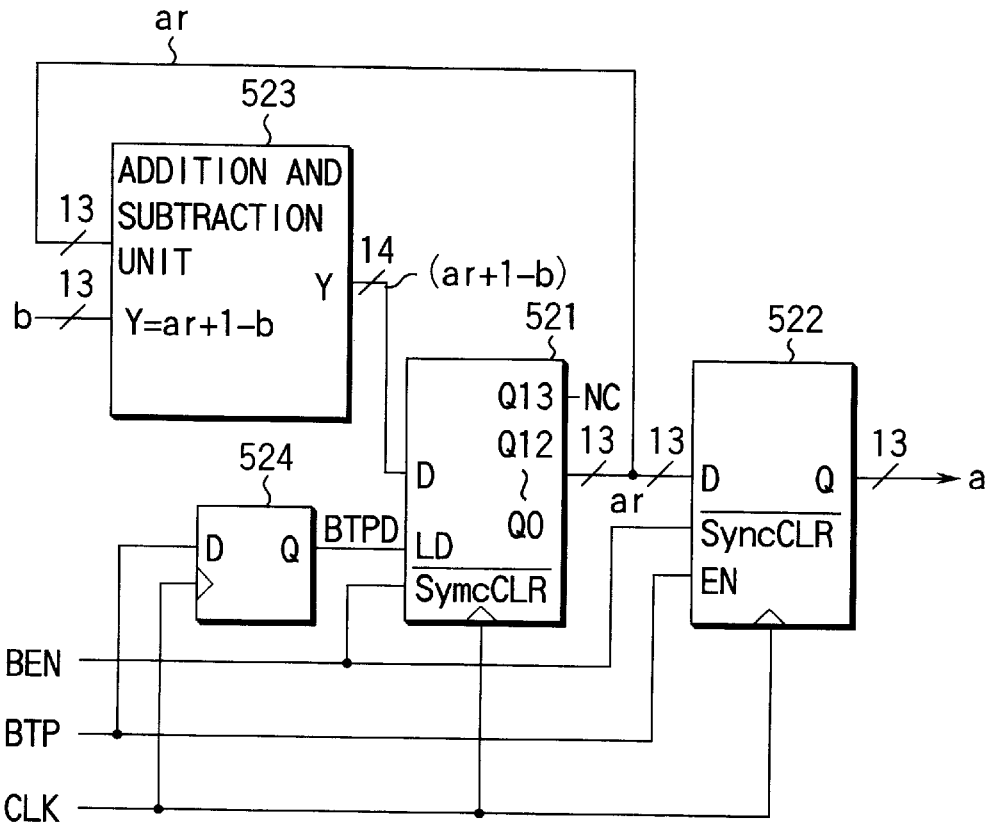
FIG. 20 is a block diagram showing the construction of the reference point passage time measuring circuit shown in FIG. 10.

As shown in FIG. 20, the reference point passage time measuring circuit 52 includes a binary counter 521 for measuring the passage time, a latch circuit 522 with Enable terminal for latching the output of the binary counter, an addition and subtraction unit 523, and a D-type flip-flop 524 for delaying the reference point pulse BTP. The binary counter 521 and addition and subtraction unit 523 deal with data of 14 bits in total including the most significant bit indicating a sign and a positive or negative number expressed in a twos complement form. The latch circuit 522 only stores a positive number and deals with 13-bit data.

The timing data converting circuit 54 inputs the 13-bit reference point passage time a from the latch circuit 522 to the memory 541 as an address and refers to the table to output data of 18 bits in total including the 13-bit print timing total time b, 4-bit print timing code c and 1-bit error output ER. Therefore, the memory 541 is a memory having a capacity of $2^{13}\times18$ bits and is constructed by a ROM, RAM or EEPROM, for example. The output timings of the reference point passage time a, print timing total time b and 4-bit print timing code c are shown in FIG. 12.

While the signal BEN indicating the measurement period is set at the low level, the binary counter 521 and latch circuit 522 of FIG. 20 are cleared and output "0". Therefore, b=c=ER=0 is output from the memory 541 of the timing data converting circuit 54 based on the table of FIG. 17.

Figure 21:
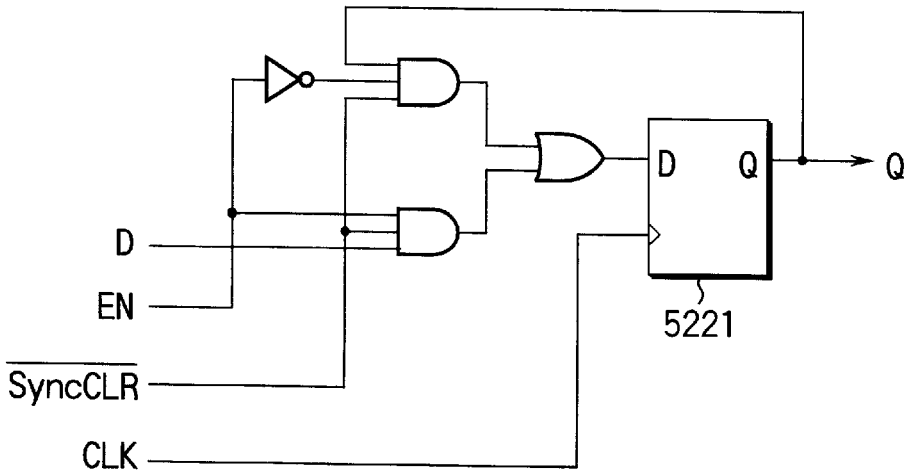
FIG. 21 is a block diagram showing the construction of a latch circuit shown in FIG. 20.

As shown in FIG. 21, the latch circuit 522 has a D-type flip-flop 5221 and is constructed to add a function of performing the operation of sync. enable EN and sync. clear /SyncCLR to the flip-flop 5221 for each bit.

As shown in FIG. 12, when the signal BEN rises, the binary counter 521 starts the counting operation. At this time, an output (reference point passage time) a from the latch circuit 522 is kept at "0". Therefore, the output from the memory 541 is b=c=ER=0.

Next, if the first reference point pulse BTP is input, the latch circuit 522 latches the present value ar=A1 of the binary counter 521. The value A1 is supplied to the address terminal of the memory 541 of the timing data converting circuit 54 as the reference point passage time a. The print timing total time b=B1 and print timing code c=C1 corresponding to the address A1 are output from the memory 541.

At the same time that the print timing total time B1 and print timing code C1 corresponding to the first value A1 of the reference point passage time are determined, a first pulse BTPD obtained by delaying the reference point pulse BTP by one clock by the flip-flop 524 is input to the load terminal LD of the binary counter 521 and data (ar+1−b) from the addition and subtraction unit 523 is loaded into the binary counter 521 via the data input terminal D. At the timing at which the first pulse BTD is loaded into the binary counter 521, the value of the binary counter 521 is ar=A1+1 and the print timing total time is b=B1.

Therefore, the value to be loaded into the binary counter 521 this time is ar+1−b=A1+2−B1. If A1=B1, ar+1−b=2 and the binary counter 521 is initialized to the value "2". Further, if A1>B1, the binary counter 521 is initialized to the value 3, 4, 5, . . . , and therefore, a portion by which the print timing total time B1 is shorter than the reference point passage time A1 at this time is compensated for in the next period. If A1<B1, the binary counter 521 is initialized to the value 1, 0, −1, −2, . . . , and therefore, a portion by which the print timing total time B1 is longer than the reference point passage time A1 at this time is compensated for by reading the next period in a short period.

Figure 22:
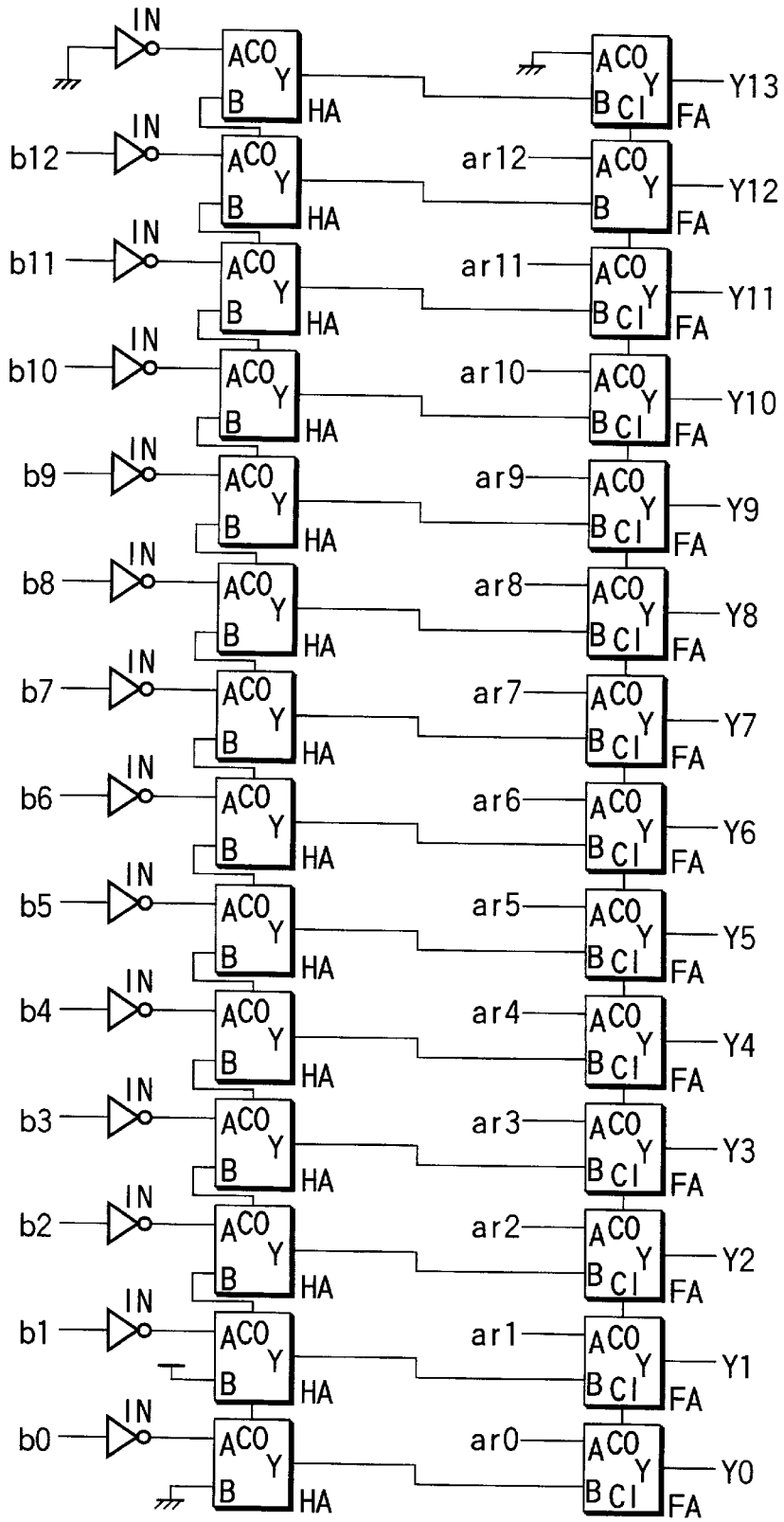
FIG. 22 is a block diagram showing the construction of an addition and subtraction unit shown in FIG. 20.

As shown in FIG. 22, the addition and subtraction unit 523 includes 14 full adders FA, 14 half adders HA and 14 inverter circuits IN. In the addition and subtraction unit 523, the inputs ar and b thereof are both 13-bit positive numbers and the output thereof is a 14-bit positive or negative number having the most significant bit Y13 indicating a sign. It performs the operation of ar+1−b={(bit inversion of b)+1}+1+ar=(bit inversion of b)+2+ar.

Thus, the reference point passage time measuring circuit 52 sequentially determines the reference point passage times A1, A2, A3, . . . obtained by correcting the print timing total times obtained up to the preceding cycle each time the reference point pulse BTP is input and the timing data converting circuit 54 sequentially determines the print timing total times B1, B2, B3, . . . and print timing codes C1, C2, C3, . . . according to the above values, and at the same time, determines the error output ER.

Figure 23:
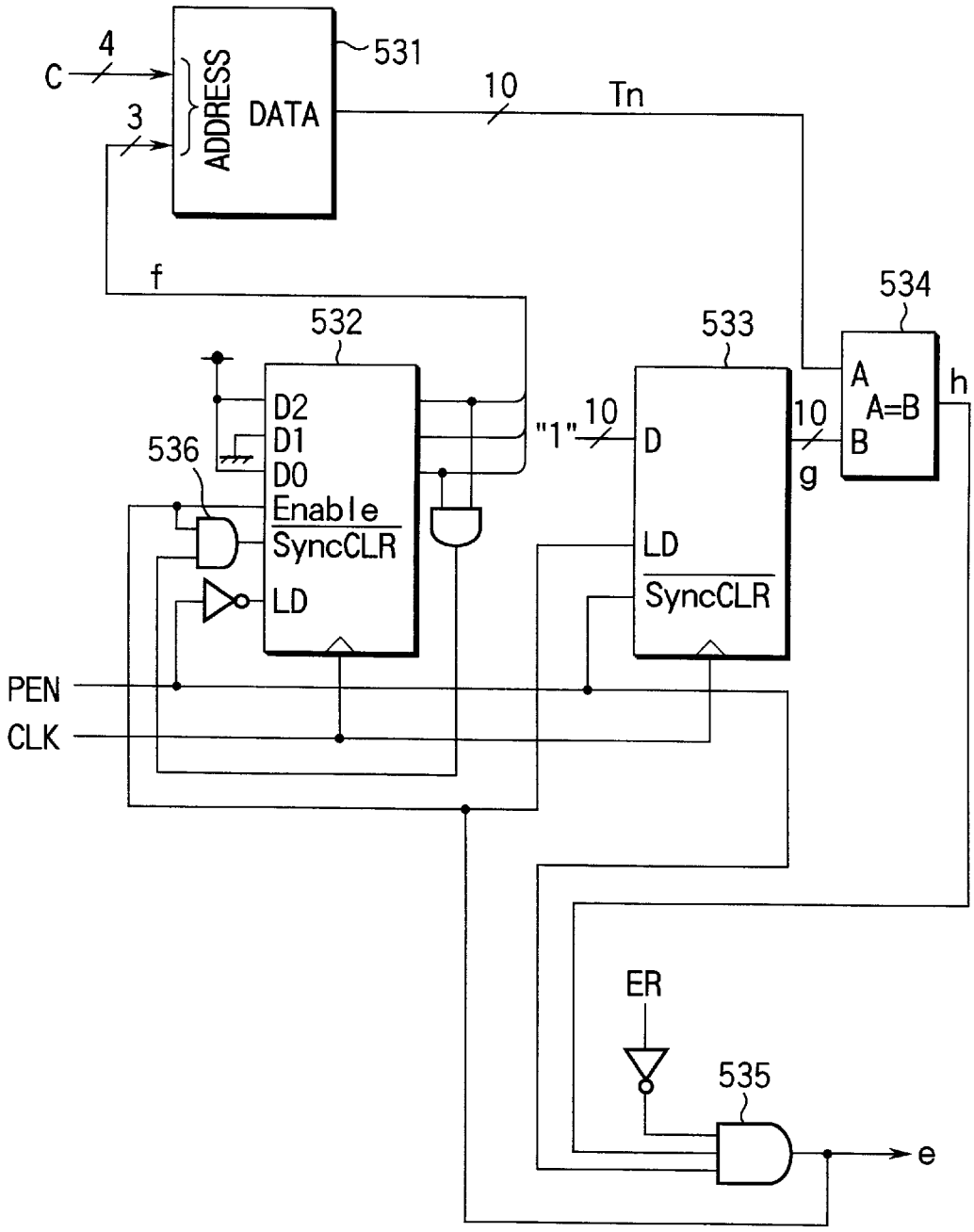
FIG. 23 is a block diagram showing the construction of the print timing pulse generating circuit shown in FIG. 10.

As shown in FIG. 23, the print timing pulse generating circuit 53 includes a memory 531 having a capacity of $2^7\times10$ bits, a 6-scale counter 532 having a 3-bit binary counter for counting 0 to 5, an energization timer 533 having a binary counter, and a coincidence detection circuit 534 and generates a print timing pulse e at an interval according to the value of the print timing code c determined by the timing converting circuit 54. That is, as shown in FIG. 12, for example, the 6-scale counter 532 outputs a value of 0 to 5 each time the print timing pulse is output according to the value of the print timing code C1 and then the count thereof is returned to "0". The 3-bit output f from the 6-scale counter 532 is supplied to the address terminal of the memory 531.

The memory 531 outputs 10-bit data by use of an address of seven bits in total including a 4-bit print timing code c and a 3-bit counter output f. The memory 531 may be constructed by a ROM, RAM or EEPROM.

The table shown in FIG. 19 is provided in the memory 531. The data relation set in the table is a data relation in which the total value of data of outputs f=0 to 5 set for one print timing code Cn coincides with the print timing total time b corresponding to the print timing code. For example, data T2 is set for all of the outputs f=0 to 5 for the print timing code C13, and 6×T2=5598, that is, it coincides with the print timing total time b=5598 corresponding to the print timing code C13. Further, data T1 is set for the outputs f=0, 1, 2, 4, 5 and data T2 is set for f=3 for the print timing code C8, and 5×T1+T2=5098, that is, it coincides with the print timing total time b=5098 corresponding to the print timing code C8.

In this example, assume that the pressure vibration period of the ink-jet print head 33 is 10 μs, that is, 100 clocks, the standard print period (frequency) of the head 33 is set to 83.3 μs (12.0 kHz), and the head 33 can effect the good printing operation even at 93.3 μs (10.7 kHz) or 73.3 μs (13.6 kHz).

Data Tn in the table of the memory 531 is one of the three values of T0=733, T1=833 and T2=933. T0, T1, T2 are adequately combined to adjust and determine the value b so that the total value of Tn of f=0 to 5 in one Cn may coincide with the value of b corresponding to 4398, 4498, 4598, 4698, . . . , 5598 by a combination of T0, T1, T2.

In this example, data is set to 10 bits and values of 733, 833, 933 are directly stored into the memory 531, but it is also possible to set data to 2 bits, express T0, T1, T2 by use of a code and use the code as an address for a memory of 4×10 bits so as to obtain values of 733, 833, 933.

Thus, the value Tn determined by the memory 531 by an input of the print timing code c is compared with the present value to be counted by the energization timer 533 in the coincidence detection circuit 534, and if the coincidence detection circuit 534 detects coincidence while the signal PEN indicating the print period is set at the high level and the error output ER is at the low level as shown in FIG. 12, the print timing pulse e is output from an AND gate 535.

Figure 24:
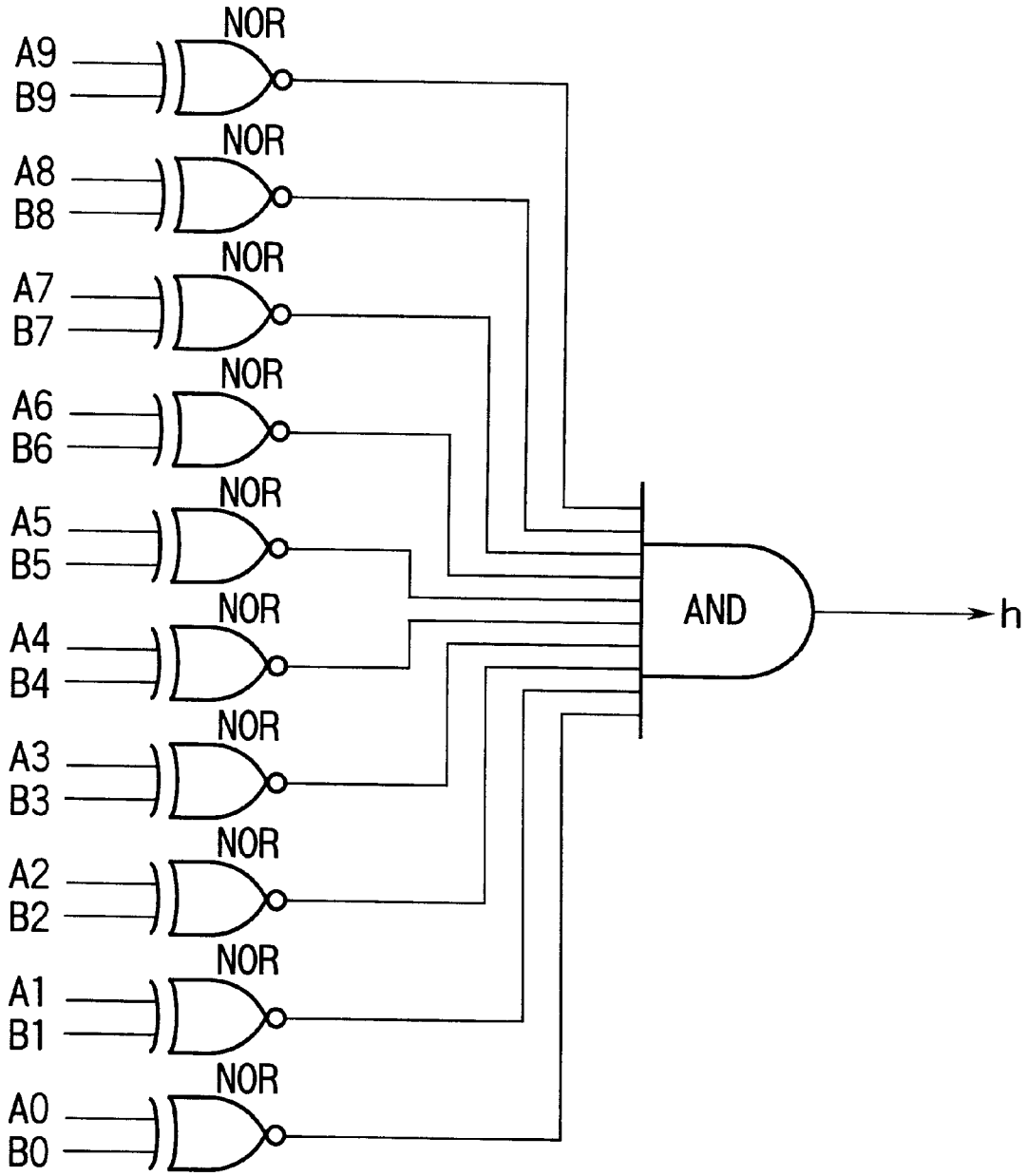
FIG. 24 is a circuit construction diagram showing a coincidence detection circuit shown in FIG. 23.

As shown in FIG. 24, the coincidence detection circuit 534 includes 10 exclusive NOR gates NOR and one 10-input AND gate AND. That is, if inputs A0 to A9 and B0 to B9 of 10 bits coincide with each other for each bit, the AND gate AND is enabled to output a coincidence output h.

The energization timer 533 is set in the cleared state while the signal PEN is kept at the low level. When the signal PEN rises from the low level to the high level, the output Tn of the memory 531 is "0" since the print timing code c is C=0, and coincidence detection of the coincidence detecting circuit 534 is attained only for one clock to output a first print timing pulse e. At the same time, the value "1" is loaded into the energization timer 533 and the time counting operation is started.

A value "5" is kept loaded into the 6-scale counter 532 while the signal PEN is set at the low level and the load state is released if the signal PEN rises to the high level. At the same time, the print timing pulse e is generated, and therefore, a NAND gate 536 is enabled and the 6-scale counter 532 is synchronously cleared to "0". At this time, the value of the print timing code c is changed from "0" to C1.

Therefore, the output Tn of the memory 531 is set to one of T0, T1, T2 according to the value of C1 based on the table of FIG. 19. If the energization timer 533 effects the time counting operation and the count thereof reaches the value of the output Tn, the coincidence detection circuit 534 detects coincidence and a next print timing pulse e is output from the AND gate 535. At this time, the energization timer 533 is initialized to "1". Further, an Enable signal is input to the 6-scale counter 532, the output f thereof proceeds from "0" to "1" and the value of next Tn is output from the memory 531. Thus, the print timing pulse generating circuit 53 sequentially generates a print timing pulse e.

The print timing pulse e from the print timing pulse generating circuit 53 is supplied to the print data generating circuit 55 and head driving waveform generating circuit 56. The print data generating circuit 55 supplies print data d to the head driving waveform generating circuit 56 in synchronism with the print timing pulse e.

Figure 25:
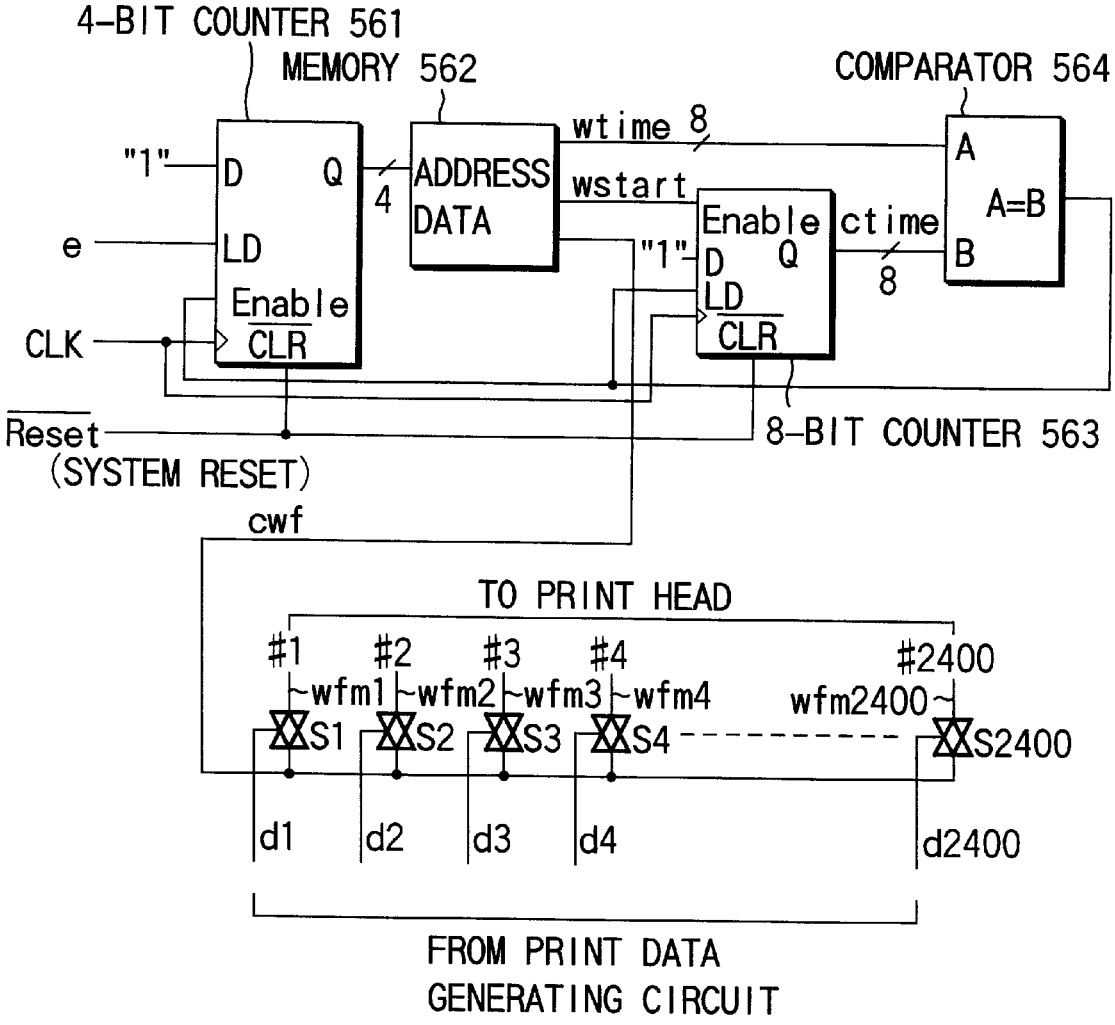
FIG. 25 is a block diagram showing the construction of a head driving waveform generating circuit shown in FIG. 10.
Figures 26, 27:
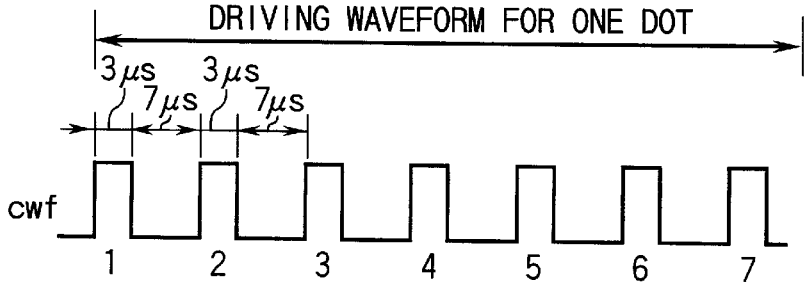
FIG. 26 is a diagram showing the construction of a table formed in a memory shown in FIG. 25.
FIG. 27 is a diagram showing the driving waveform of an ink-jet print head obtained by the head driving waveform generating circuit shown in FIG. 25.

As shown in FIG. 25, the head driving waveform generating circuit 56 includes a 4-bit counter 561, memory 562, 8-bit counter 563, comparator 564 and switching elements S1 to S2400 corresponding to 2400 head elements (ink chambers) and the memory 562 is a memory of $2^4$×10 bits and a table shown in FIG. 26 is provided in the memory.

The driving waveform cwf necessary for the ink-jet print head 33 to print one dot is a waveform shown in FIG. 27. That is, the waveform is a pulse signal including seven pulses having a period of 10 μs and a pulse width of 3 μs. Since the head does printing by use of pressure vibration, the period is set to 10 μs. The reason why the seven pulse waves are required for one-dot printing is to obtain an adequate amount of ink corresponding to the necessary density of each dot.

In the initialization state, the 4-bit counter 561 is cleared to "0" by the system reset /Reset from the system reset generator 39. Therefore, the outputs of the memory 562 are wtime=255, watart=0 and cwf=0 according to the table of FIG. 26. Further, since the 8-bit counter 563 is also cleared, the output thereof is ctime=0. Therefore, the comparator 564 is disabled and the output of the comparator 564 is kept at the low level and the Enable signal to the 4-bit counter 561 is set at the low level.

In this state, if the system reset /Reset from the system reset generator 39 rises from the low level to the high level, the clear states of the 4-bit counter 561 and 8-bit counter 563 are released, but the state in which the Enable signal thereto is set at the low level is kept unchanged so that the counters 561, 563 and comparator 564 will be kept unchanged to maintain the initialization state. After this, if the print timing pulse e is input to the 4-bit counter 561, "1" is loaded into the counter 561.

As a result, the memory 562 outputs data corresponding to the address "1", that is, wtime=30, wstart=1, and cwf=1 in response to a next clock CLK. If cwf=1 is attained, a high level potential is applied to the switch elements S1 to S2400. The switch control of the switch elements S1 to S2400 is effected according to print data d1 to d2400 of a first dot to a 2400th dot of the ink-jet print head 33 and the data items are generated from the print data generating circuit 55.

That is, only those of the switch elements corresponding to dots to be printed are turned ON and the driving waveforms cwf applied thereto are applied to the driving sections of the corresponding ink chambers of the print head. Further, the Enable terminal of the 8-bit counter 563 is activated by wstart=1 and the counter 563 starts the counting operation. When 3 μs has passed, the value of ctime of the 8-bit counter 563 becomes "30" and the comparator 564 is enabled.

If the comparator 564 is enabled, a pulse is input to the Enable terminal of the 4-bit counter 561 and the counter 561 is counted up by one from "1" to "2". As a result, the address of the memory 562 is set to "2", and the memory 562 outputs data corresponding to the address "2", that is, wtime=70, wstart=1, cwf=0. When cwf=0, a signal applied to the ink chamber of the head 33 to be printed is changed from the high level to the low level.

Since the coincidence output from the comparator 564 is also supplied to the load terminal LD of the 8-bit counter 563, the 8-bit counter 563 is initialized to "1". At this time, since wtime=70, the 8-bit counter 563 counts for 7 μs and when the count thereof reaches 70, the comparator 564 detects coincidence again. If the comparator 564 thus detects coincidence, the 4-bit counter 561 is counted up by one from "2" to "3" and the memory 562 outputs data corresponding to the address "3", that is, wtime=30, wstart=1, cwf=1. Thus, a high level signal is applied for 3 μs to the driving section of the corresponding ink chamber of the print head via the switch element corresponding to the dot to be printed.

Thus, the driving waveform of 7 pulses as shown in FIG. 27 is applied to the driving section of the corresponding ink chamber and ink is ejected from the ink-jet nozzle. After the driving waveform is applied, the count of the 4-bit counter 561 is set to "14" and the memory 562 outputs data of wtime=255, wstart=0, cwf=0 according to the table of FIG. 26.

Further, the 8-bit counter 563 stops the counting operation since a signal applied to the Enable terminal thereof becomes "0" while the value "1" is kept loaded therein. At this time, since the comparator 564 is disabled, the 4-bit counter 561 also stops the counting operation. The state is maintained until a next print timing pulse e is input.

It is possible to change the duty of the driving waveform and the pulse number thereof by changing the values of the table of the memory 562.

The print data generating circuit 55 may be used to supply print data d1 to d2400 at timings at which the switch elements S1 to S2400 are stably turned ON/OFF only in a period in which the driving waveform of 7 pulses is effective. Further, an ink ejection amount can be changed by changing times in which signals for turning ON the switch elements S1 to S2400 are applied according to print data d1 to d2400 in the driving waveform of the 7 pulses and in synchronism with the driving waveform cwf of FIG. 27 for every 10 $\mu$s so as to attain printing with gradation.

Therefore, the same operation and effect as those in the first embodiment can be attained in this embodiment.

Figure 28:
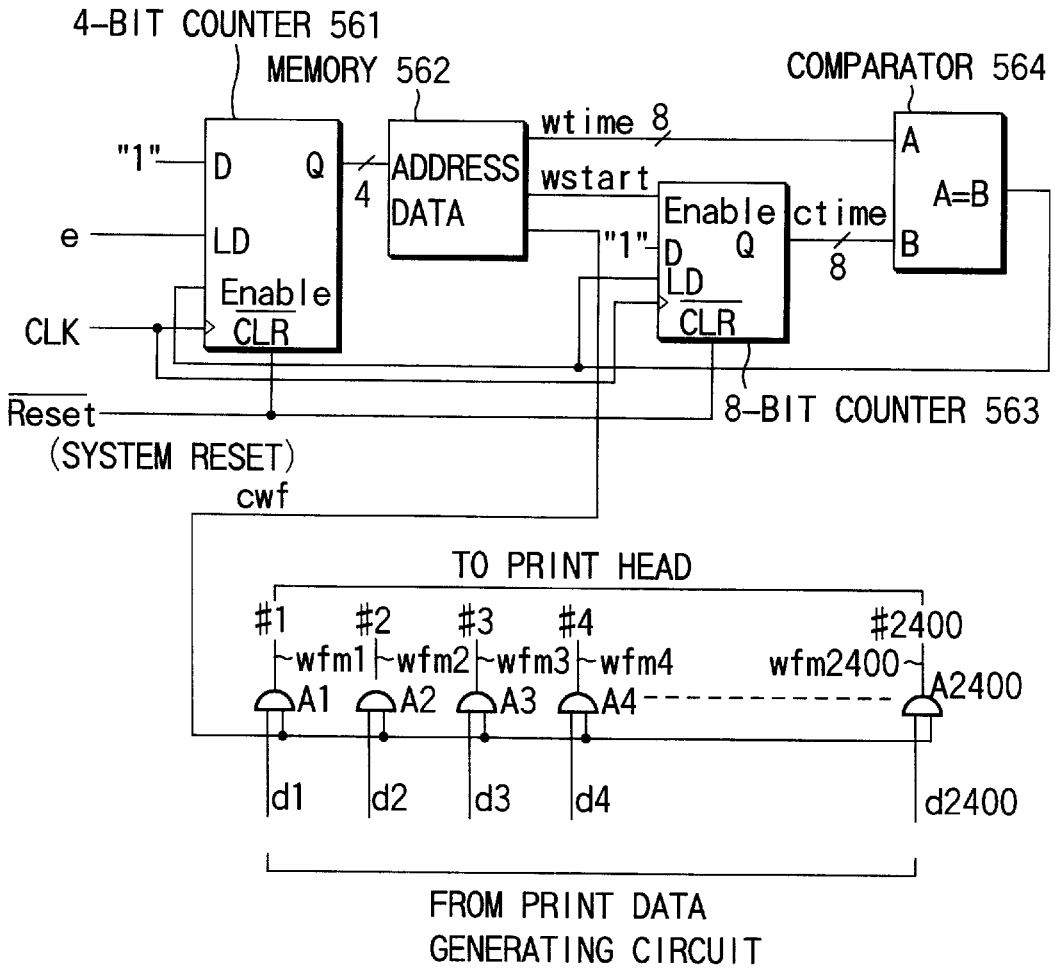
FIGS. 28 and 29 are block diagrams showing modifications of the head driving waveform generating circuit shown in FIG. 25.

In this embodiment, the switch elements S1 to S2400 are used in the head driving waveform generating circuit 56, but this is not limitative and AND gates A1 to A2400 can be used as shown in FIG. 28 to attain the same control operation.

Figure 29:
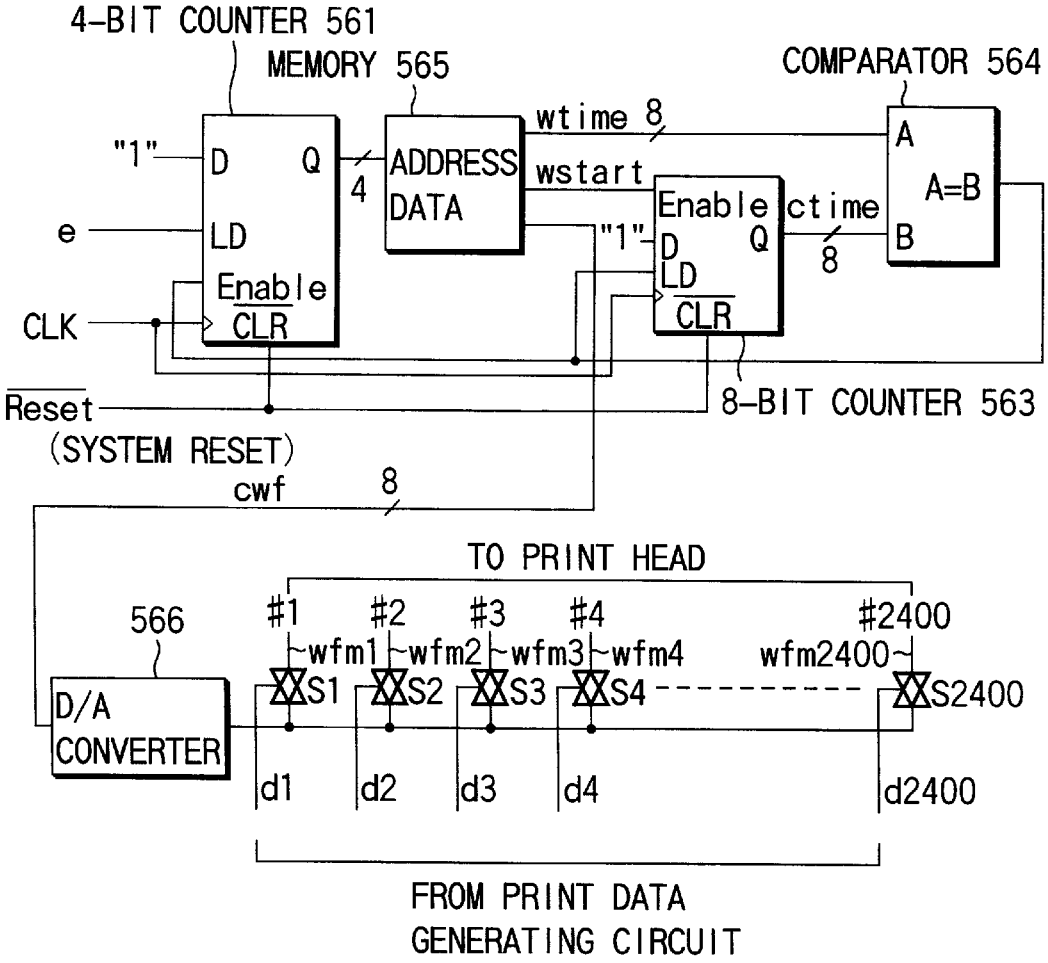

Further, in this embodiment, cwf output from the memory 562 of the head driving waveform generating circuit 56 is one bit and time for changing the one bit to the low level or high level is controlled to create and apply the driving waveform to each of the switch elements S1 to S2400, but this is not limitative, and as shown in FIG. 29, a memory 565 having an increased bit number can be used and cwf output from the memory 565 may be applied to a D/A converter 566 as 8-bit data, for example, 8-bit data may be converted into an analog voltage waveform by the D/A converter 566 and given voltage waveforms corresponding to the data items may be applied to the switch elements S1 to S2400.

Figure 30:
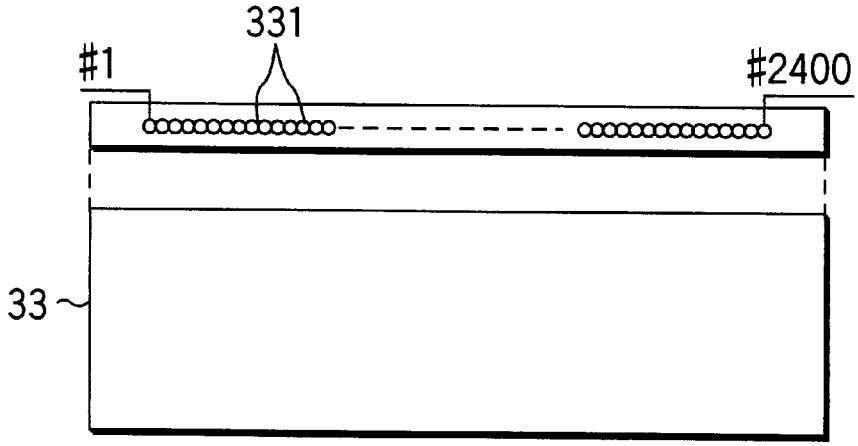
FIG. 30 is a view showing an example of the array of ink-jet nozzles of the ink-jet print head shown in FIG. 10.
Figure 32A:
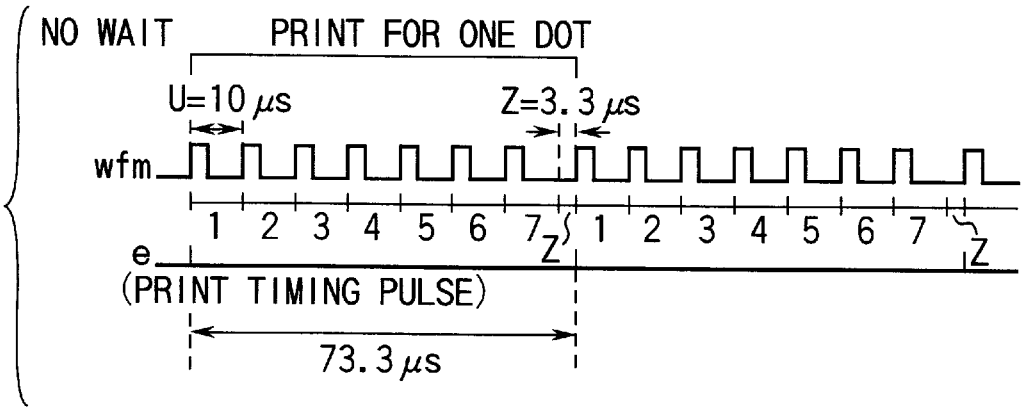
FIGS. 32A to 32C are diagrams showing driving waveforms for driving the ink-jet print head shown in FIG. 30.
Figure 32B:
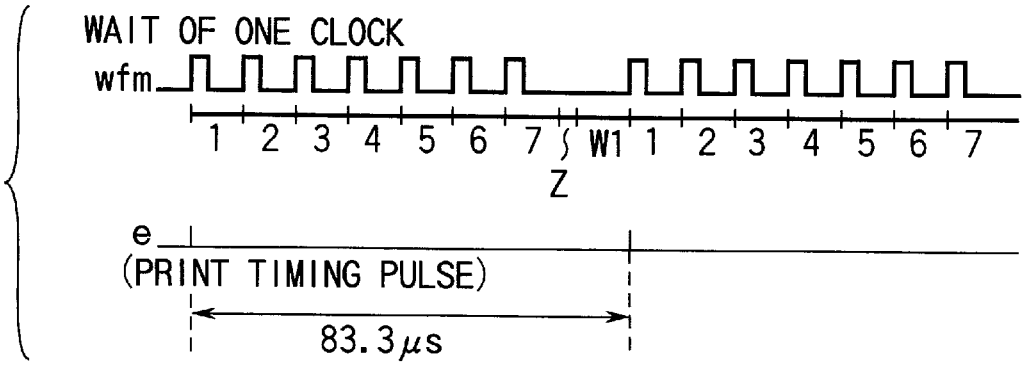
Figure 32C:
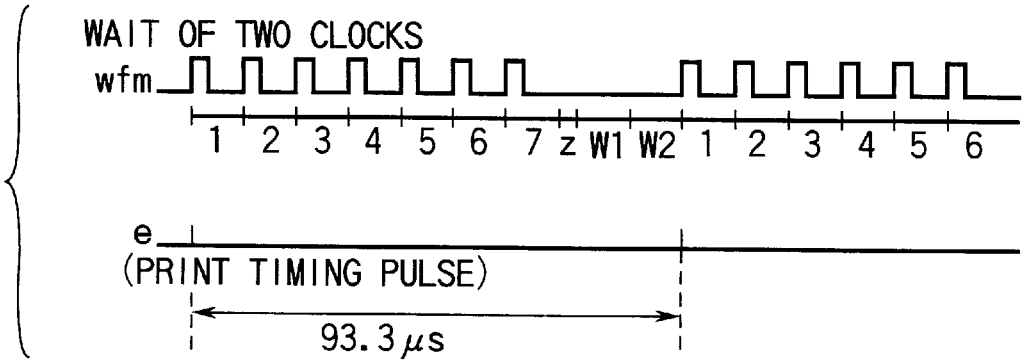

As shown in FIG. 30, the ink-jet print head 33 has a linear array of ink-jet nozzles 331 with an interval of 300 dpi and is driven by driving waveforms shown in FIGS. 32A to 32C. FIG. 32A shows the driving waveform when time required for printing one dot is T0=73.3 $\mu$s, FIG. 32B shows the driving waveform when time required for printing one dot is T1=83.3 $\mu$s, and FIG. 32C shows the driving waveform when time required for printing one dot is T2=93.3 $\mu$s. In this embodiment, one of T0, T1, T2 is selectively used according to the result of rotation detection of the rotary drum 31 by the rotary encoder 46.

Time of Z=3.3 $\mu$s in the drawing indicates delay time set to permit the phase of pressure vibration when one-dot printing is terminated to be set to a state which is most suitable for next printing. In FIG. 32A, the delay time is only Z, but in the case of FIG. 32B, the delay time W1=10 $\mu$s is added, and in the case of FIG. 32C, the delay time W2=10 $\mu$s is further added. That is, in the case of FIG. 32C, the delay time of 20 $\mu$s in total is added. In the case of FIG. 32B, the phase of pressure vibration at the end of one-dot printing is set to a state which is most suitable for next printing by setting the delay time to (Z+W1), and in the case of FIG. 32C, the phase of pressure vibration at the end of one-dot printing is set to a state which is most suitable for next printing by setting the delay time to (Z+W1+W2).

Figure 31:
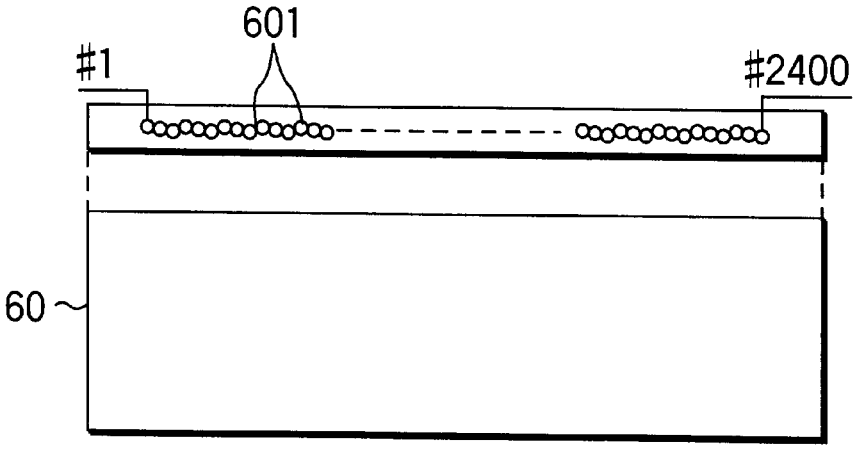
FIG. 31 is a view showing a modification of the ink-jet nozzles of the ink-jet print head shown in FIG. 10.

In this example, the linear array of ink-jet nozzles is explained as the ink-jet print head, but the arrangement of the ink-jet nozzles is not necessarily limited to the linear array and, for example, it is possible to easily cope with an ink-jet print head 60 having ink-jet nozzles 601 which are obliquely arranged for every three ink-jet nozzles as shown in FIG. 31.

Figure 33A:
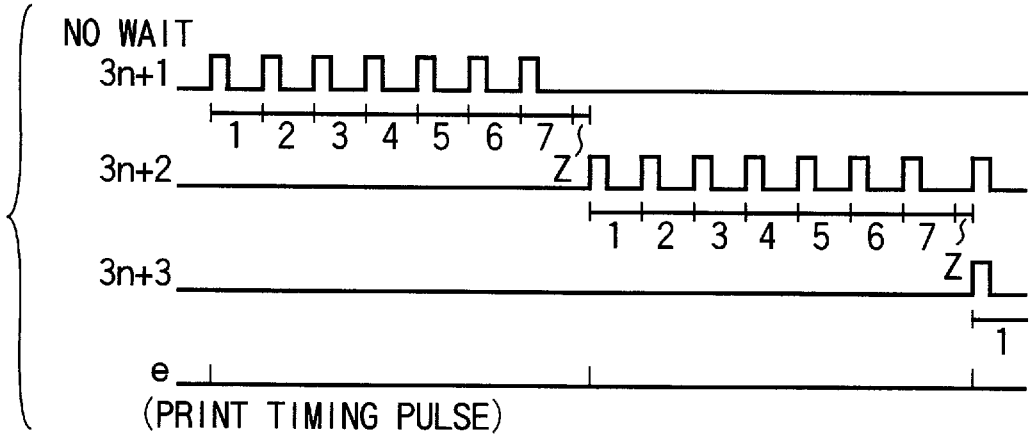
FIGS. 33A to 33C are diagrams showing driving waveforms for driving the ink-jet print head shown in FIG. 31.
Figure 33B:
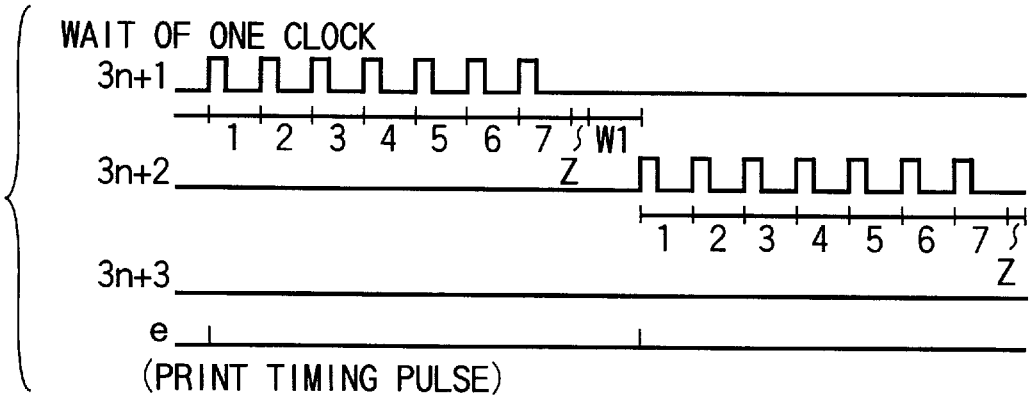
Figure 33C:
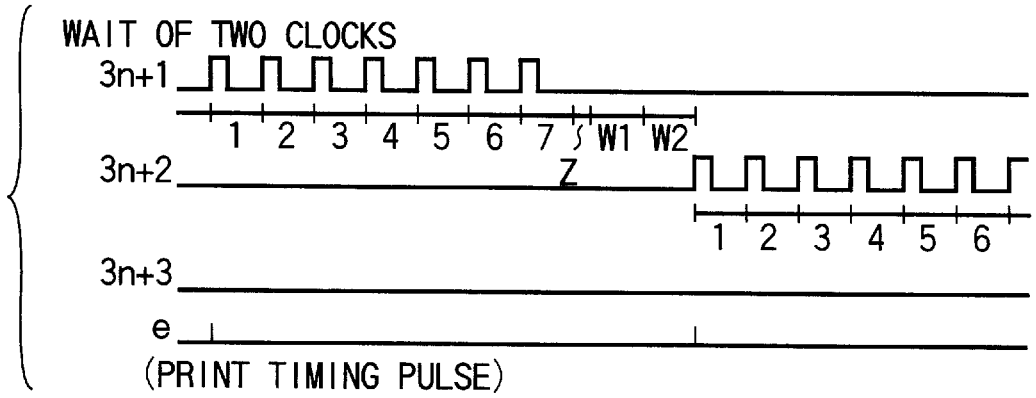
Figure 34:
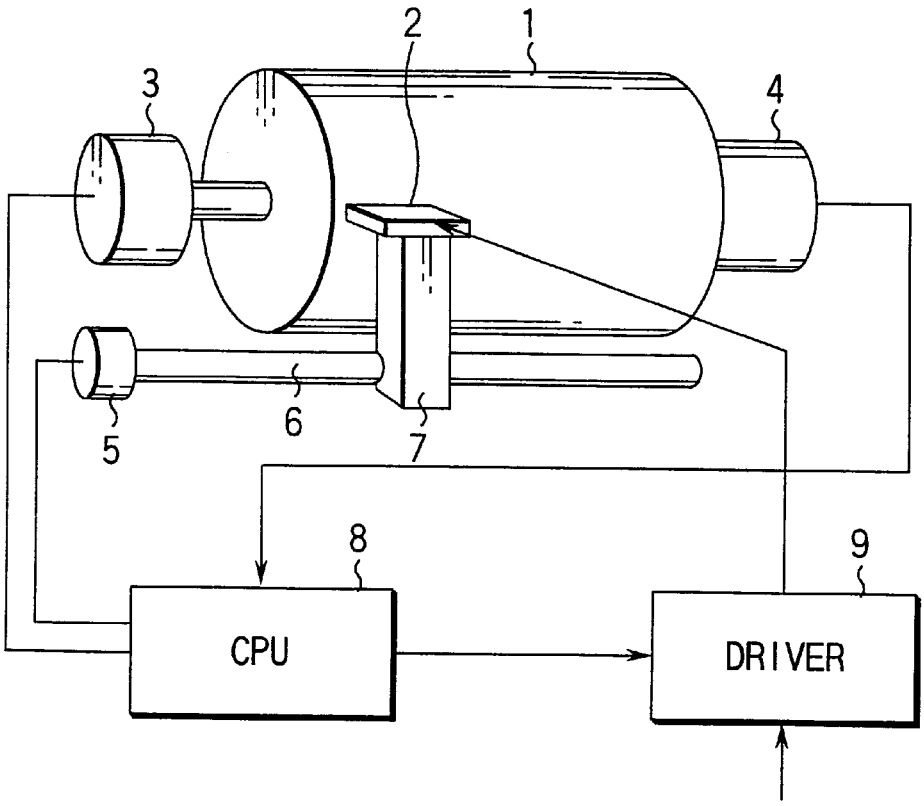
FIG. 34 PRIOR ART
FIGS. 34 and 35 are views showing conventional ink-jet printers.
Figure 35:
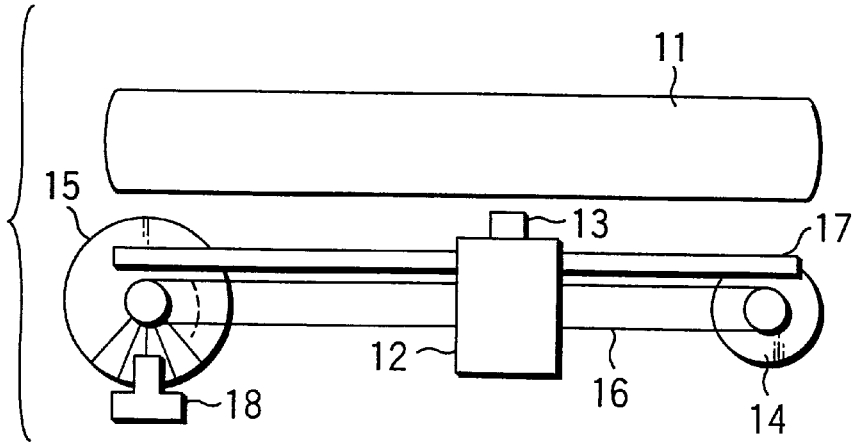
FIG. 35 PRIOR ART
Figure 36:
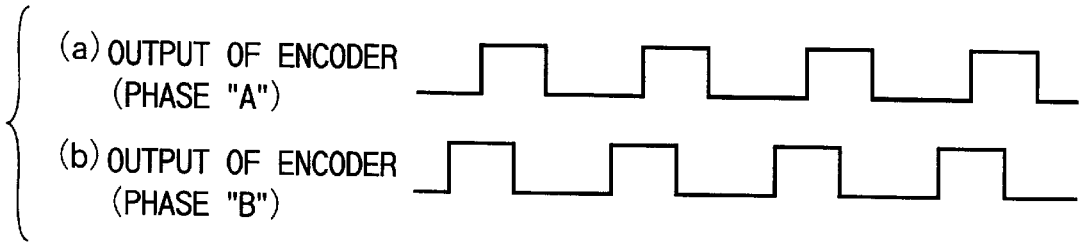
FIG. 36 PRIOR ART
FIG. 36 is a waveform diagram showing an encoder sensor output shown in FIG. 35.
Figure 37:
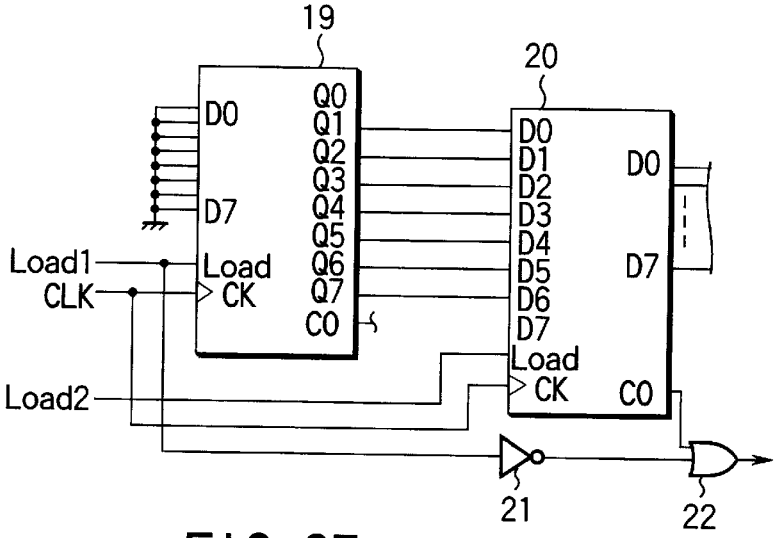
FIG. 37 PRIOR ART
FIG. 37 is a block diagram partially showing the circuit construction of the ink-jet printer shown in FIG. 35.
Figure 38:
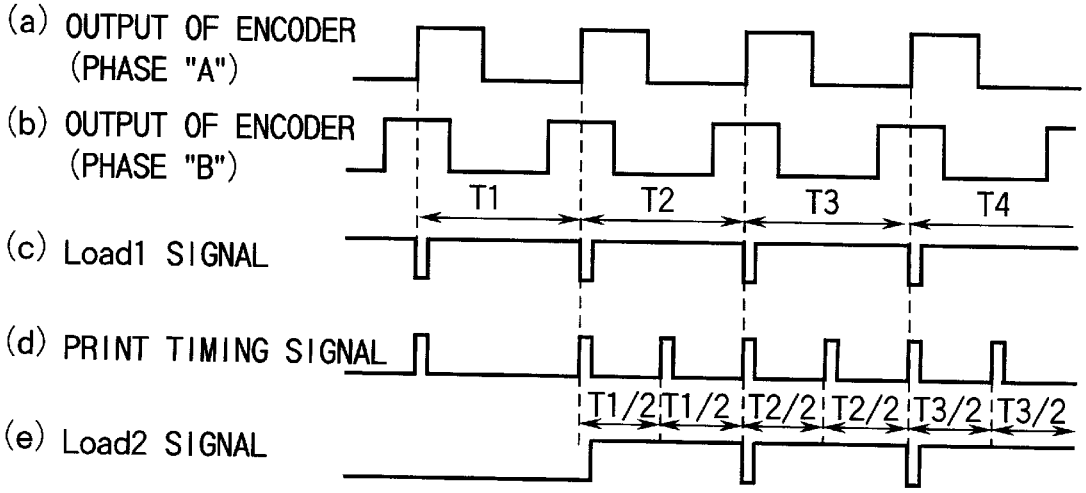
FIG. 38 PRIOR ART
FIG. 38 is a timing waveform diagram for illustrating the operation of the circuit shown in FIG. 37.

The driving waveforms used when the ink-jet print head 60 is used are 3-phase waveforms as shown in FIGS. 33A, 33B, 33C.

In each of the above embodiments, a case wherein the line head with the paper width size is used as the print head, printing paper is wound around the rotary drum, and the head and the printing paper are moved relatively to each other by rotation of the rotary drum is explained, but this not limitative and it is possible to use a printer in which a head having several to more than ten ink-jet nozzles arranged in the line direction, for example, is used as the print head, the head is moved in the line direction by a small amount each time the rotary drum is rotated by one rotation while the rotation control for the rotary drum is effected, and the rotary drum is rotated by several rotations to terminate printing on one sheet of printing paper. Further, for example, it is possible to use a serial printer in which a head having several ink-jet nozzles arranged in a direction perpendicular to the line direction with respect to the platen is used as the print head and the head is moved in the line direction to do printing for each line. This invention can be applied to a printer in which the line head is moved in a direction perpendicular to the line direction without moving printing paper to do printing. That is, this invention is not limited to a printer of a type based on the relative movement between the print head and printing paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A printer control apparatus for a printer which performs printing on a recording medium relatively moved with respect to a print head, comprising:

position detecting means for detecting relative movement between the print head and the recording medium at each equal positional interval;

time measuring means for measuring passage time of the positional interval detected by said position detecting means; print timing pulse train generating means for generating a train of print timing pulses with a time interval corresponding to and shorter than the passage time of the positional interval measured by said time measuring means;

head driving means triggered by each print timing pulse from said print timing pulse train generating means, for driving said print head; and print-required time determining means for determining total required time for generation of the train of print timing pulses from said print timing pulse train generating means according to the passage time of the positional interval measured by the time measuring means;

wherein said print timing pulse train generating means is arranged such that generation of a next train of print timing pulses starts when the total required time determined by said print-required time determining means has elapsed after generation of the print timing pulse train.

2. The printer control apparatus according to claim 1, wherein the total required time determined by said print-required time determining means is set equal to the passage time of the positional interval measured by said time measuring means.

3. The printer control apparatus according to claim 1, wherein said time measuring means is arranged to accumulate time by setting a preset position detected by said position detecting means as a starting point, output an accumulated value of time obtained when said position detecting means next detects the position as the passage time of the positional interval, and then re-start a next time accumulating operation.

4. The printer control apparatus according to claim 1, wherein said time measuring means includes:

accumulating means for accumulating time by setting a preset position detected by said position detecting means as a starting point;

subtraction means for subtracting the total required time determined by said print-required time determining means; and accumulated value outputting means for outputting an accumulated value of time obtained when said position detecting means next detects the position as the passage time of the positional interval.

5. The printer control apparatus according to claim 1, wherein said print timing pulse train generating means includes pulse interval determining means for discretely and selectively determining the time intervals for the print timing pulses based on the passage time of the positional interval measured by said time measuring means.

6. The printer control apparatus according to claim 1, wherein said printer includes a rotary drum for holding the recording medium wound around the drum and rotating to relatively move the recording medium with respect to the print head, and said position detecting means includes a rotary encoder for detecting rotation of the drum.

7. A printer control apparatus for a printer which performs printing on a recording medium relatively moved with respect to a print head, comprising:

reference point pulse generating means for generating a reference point pulse each time it is measured or predicted that the relative position between the print head and the recording medium has reached a position of a predetermined equal positional interval;

pulse correcting means for correcting pulse generation time of the reference point pulse from said reference point pulse generating means according to a predetermined constraint condition and outputting a print timing pulse; and head driving means triggered by the print timing pulse from said pulse correcting means, for driving the print head.

8. The printer control apparatus according to claim 7, wherein said pulse correcting means includes a timer for measuring passage time after the print timing pulse is generated in a preceding cycle; and print timing pulse outputting means for outputting print timing pulses obtained by correction of delaying the reference point pulse until the passage time measured by said timer has reached one of a plurality of pulse intervals previously selected for driving.

9. A printer control apparatus for a printer which performs printing on a recording medium relatively moved with respect to a print head, comprising:

position detecting means for detecting relative movement between the print head and the recording medium at each equal positional interval;

print timing pulse generating means for generating a train of print timing pulses which enable driving of the print head; and pulse interval determining means for discretely and selectively determining time intervals for the print timing pulses from said print timing pulse generating means based on the positional interval detecting timing of said position detecting means.

10. The printer control apparatus according to claim 9, wherein said pulse interval determining means is arranged to sequentially determine the time intervals for the print timing pulses based on values of a table developed on a memory.

11. The printer control apparatus according to claim 9, wherein an ink-jet print head is used as the print head and said pulse interval determining means discretely determines the time intervals for the print timing pulses by using an integer multiple of a period of pressure vibration of ink in an ink chamber of the ink-jet print head as one unit.

12. The printer control apparatus according to claim 9, wherein said printer includes a rotary drum for holding the recording medium wound around the drum and rotating to relatively move the recording medium with respect to the print head, and said position detecting means includes a rotary encoder for detecting rotation of the drum.

13. A printer control apparatus for a printer which performs printing on a recording medium relatively moved with respect to the paper, comprising:

position detecting means for detecting relative movement between the print head and the recording medium at each equal positional interval;

print timing pulse generating means for generating print timing pulses which enable driving of the print head; and pulse interval determining means for determining time intervals for the print timing pulses from said print timing pulse generating means based on the positional interval detecting timing of said position detecting means and limiting the range of the time interval by use of the upper limit, lower limit or both of the upper and lower limits of a driving frequency of the print head.

14. The printer control apparatus according to claim 13, wherein said printer includes a rotary drum for holding the recording medium wound around the drum and rotating to relatively move the recording medium with respect to the print head, and said position detecting means includes a rotary encoder for detecting rotation of the drum.

* * * * *